US012157996B2

(12) United States Patent
Borkholder et al.

(10) Patent No.: US 12,157,996 B2
(45) Date of Patent: Dec. 3, 2024

(54) CONSTRUCTION SYSTEMS FOR POST FRAME BUILDINGS AND STRUCTURES

(71) Applicant: Innovative Structures, LLC, Bremen, IN (US)

(72) Inventors: Dwayne Borkholder, Roanoke, IL (US); Todd Meinhold, Roanoke, IL (US)

(73) Assignee: Innovative Structures, LLC, Bremen, IN (US)

( * ) Notice: Subject to any disclaimer, the term of this patent is extended or adjusted under 35 U.S.C. 154(b) by 0 days.

(21) Appl. No.: 18/745,334

(22) Filed: Jun. 17, 2024

(65) Prior Publication Data

US 2024/0337100 A1 Oct. 10, 2024

Related U.S. Application Data

(63) Continuation of application No. PCT/US2022/053043, filed on Dec. 15, 2022.
(Continued)

(51) Int. Cl.
*E04B 1/26* (2006.01)

(52) U.S. Cl.
CPC .... *E04B 1/2604* (2013.01); *E04B 2001/2644* (2013.01); *E04B 2001/2684* (2013.01)

(58) Field of Classification Search
CPC ..... E04B 1/2604; E04B 2001/2644; E04B 2001/2684
See application file for complete search history.

(56) References Cited

U.S. PATENT DOCUMENTS 3,143,165 A * 8/1964 Lewis ..... E04B 1/0046 160/394
6,643,986 B2 * 11/2003 Commins ..... E04B 1/10 52/800.18
(Continued)

FOREIGN PATENT DOCUMENTS

JP 3486866 B2 * 1/2004

OTHER PUBLICATIONS

Search Report and Written Opinion for PCT/US2022/053043 (20 pages). (Year: 2023).*

*Primary Examiner* — Rodney Mintz
(74) *Attorney, Agent, or Firm* — Barnes & Thornburg LLP

(57) ABSTRACT

A construction systems for building a post frame building structure using a rapid framing system. The post frame building structure including a plurality of posts and a wall assembly coupled to said plurality of posts. The wall assembly including an elongated horizontal top member with a first end and a second end, an elongated horizontal bottom member with a first end and a second end, a first end member abutting both the first end of the elongated horizontal top member and the first end of the elongated horizontal bottom member, a second end member abutting both the second end of the elongated horizontal top member and the second end of the elongated horizontal bottom member, a plurality of horizontal girts positioned between the elongated horizontal top member and the elongated horizontal bottom member. The elongated horizontal top and bottom members, first and second end members, and plurality of horizontal girts are coupled to one another using a plurality of coupling plates, and wherein a gap is formed between a lower edge of the elongated horizontal bottom member and the ground, whereby said wall assembly is suspended above the ground.

23 Claims, 25 Drawing Sheets

Related U.S. Application Data

(60) Provisional application No. 63/323,481, filed on Mar. 24, 2022, provisional application No. 63/289,966, filed on Dec. 15, 2021.

(56) References Cited

U.S. PATENT DOCUMENTS

| | | | | |
|---|---|---|---|---|
| 6,871,456 | B1 * | 3/2005 | Mueller | E04H 9/14 52/167.4 |
| 7,665,250 | B2 * | 2/2010 | Powell | E04F 15/02411 52/297 |
| 9,920,514 | B1 * | 3/2018 | Brekke | E04B 7/022 |
| 10,041,288 | B1 * | 8/2018 | Flood | E04B 2/44 |
| 10,920,414 | B2 * | 2/2021 | Gordon | E04B 1/34321 |
| 11,391,038 | B2 * | 7/2022 | LeBlang | E04B 1/2604 |
| 2002/0026767 | A1 * | 3/2002 | Dowland | E04B 7/022 52/745.1 |
| 2002/0095896 | A1 * | 7/2002 | Commins | E04B 1/10 52/483.1 |
| 2004/0237439 | A1 * | 12/2004 | Powell | E04B 1/34823 52/505 |
| 2018/0073239 | A1 * | 3/2018 | Brekke | E04B 1/2608 |
| 2019/0242112 | A1 * | 8/2019 | LeBlang | E04B 1/2403 |
| 2019/0292770 | A1 * | 9/2019 | Gordon | E04B 1/34384 |
| 2020/0208399 | A1 * | 7/2020 | Keller | E04B 7/024 |

* cited by examiner 500c
550c
526
510
506
506
506
506
504
504
80
80
122
90
90
1600
1600
1600

CONSTRUCTION SYSTEMS FOR POST FRAME BUILDINGS AND STRUCTURES

RELATED APPLICATIONS

This application claims priority to PCT/US22/53043 and the benefit from U.S. provisional patent application No. 63/289,966, filed 15 Dec. 2021, and 63/323,481, filed 24 Mar. 2022, which are both incorporated herein by this reference.

TECHNICAL FIELD

The invention relates to improved construction systems including a rapid framing system and an adjustable anchor system, both for a post frame building structure. More specifically, a rapid framing system that involves: (i) the design and fabrication of the wall and/or roof segments at a manufacturing location, (ii) shipping the walls and/or roof segments to a job site location, and (iii) at the job site location, the coupling of the wall and/or roof segments are coupled to the post to form the building structure. The adjustable anchoring system includes a track assembly, a securing element, and a fastener assembly that combine to allow for the securement of the support posts in a variety of locations along the footer of the building structure. The precise location of the securement of the support posts in the track assembly and along the footer can be adjusted at the job site as the building structure is being constructed.

BACKGROUND

Conventional construction systems for post frame buildings suffer from a number of shortcomings. For example, conventional post cannot be moved or relocated to account for: (i) alterations in building plans after the post have been set, or (ii) mistakes made in locating the post in a desired location. Once the conventional post are set, a substantial amount of labor is required at the job site to build the structure. Accordingly, there is an unmet need for the use of inventive construction systems for post frame buildings, wherein said systems each and collectively reduce the labor required at the job site to fabricate the building structure, permit the precise adjustment for securement of the posts, improve the rigidity of the building structure, increase the efficiency of the build process, and advance job site safety. The description provided in the background section should not be assumed to be prior art merely because it is mentioned in or associated with the background section. The background section may include information that describes one or more aspects of the subject of the technology. A full discussion of the features and advantages of the present disclosure is deferred to the following detailed description, which proceeds with reference to the accompanying drawings.

BRIEF DESCRIPTION OF THE DRAWINGS

The drawing figures depict one or more implementations in accord with the present teachings, by way of example only, not by way of limitation. In the figures, like reference numerals refer to the same or similar elements.

DETAILED DESCRIPTION

In the following detailed description, numerous specific details are set forth by way of examples in order to provide a thorough understanding of the relevant teachings. However, it should be apparent to those skilled in the art that the present teachings may be practiced without such details. In other instances, well-known methods, procedures, components, and/or circuitry have been described at a relatively high level, without detail, to avoid unnecessarily obscuring aspects of the present disclosure.

While this disclosure includes a number of embodiments in many different forms, particular embodiments will be described in greater detail with the understanding that the present disclosure is to be considered as an exemplification of the principles of the disclosed methods and systems, and is not intended to limit the broad aspects of the disclosed concepts to the embodiments illustrated. As will be realized, the subject technology is capable of other and different configurations; several details are capable of modification in various respects, embodiments may be combined, steps for installation may be omitted or performed in a different order, all without departing from the scope of the subject technology. Accordingly, the drawings and detailed descriptions should be regarded as illustrative in nature and not as restrictive.

Disclosed herein is a rapid framing system 1 that reduces the labor required at the job site to build the structure, helps locate and plum posts, improves the rigidity of the structure, and increases job site safety. To achieve these benefits, the rapid framing system 1 designs and manufactures wall assemblies, panels or sections 500*a*-500*d* at a first location or manufacturing facility, ships the assembled wall assemblies 500*a*-500*d* to a second location or job site, and installs the wall assemblies 500*a*-500*d* to post 80. These wall assemblies 500*a*-500*d* may be custom designed for each post frame building, a partial-custom design (i.e., select from a limited number of standard designs), or may have a standard design. If the wall sections have a partial-custom design or a standard design, the wall assemblies 500*a*-500*d* may be sold to the consumers in a kit or package format. Additional benefits of this system 1 can be understood by one skill in the art based on the discloser and figures.

1) Plans for the Building Structure

Figure 1:
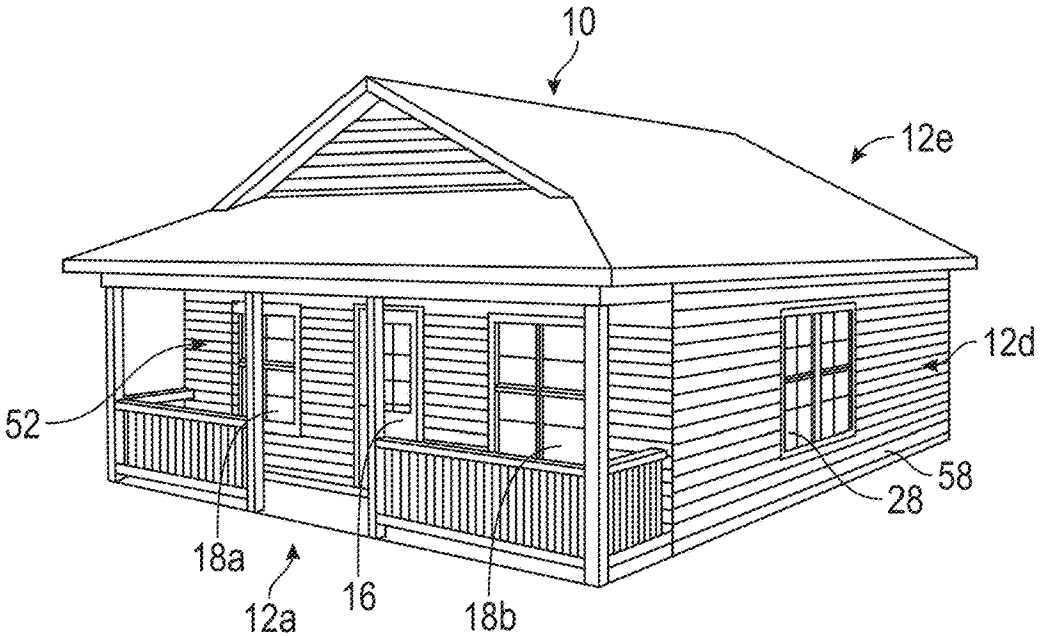
FIG. 1 is a perspective view of a building structure erected with the inventive constructions systems.

FIG. 1 show digital renderings of a building structure 10. In particular, the digital rendering show: (i) a front portion 12*a*, with a door 16 and two windows 18*a*, 18*b*, (ii) a first side portion 12*b*, (iii) a rear portion 12*c*, with a door 20, a first window 22, and a second window 24, (iv) a second side portion 12*d*, with a window 28, and (v) a roof portion 12*c*. This digital rendering of the building structure 10 can then be turned into a building plan that can be used to build said building 10. It should be understood that the building structure 10 is a representative structure that contains representative features (e.g., doors 16, 20, and windows 18*a*, 18*b*, 22, 24, 28). As such, the principles and disclosure contained in this Application in connection with this representative structure 10 and representative features can be applied to structures that have: (i) more complex configuration (e.g., more than 4 walls, and/or are non-rectangular), (ii) include more features (e.g., more than two doors and/or more than five windows), (iii) less complex configurations (e.g., have three walls), and/or (iv) include fewer features (e.g., include a single door and no windows).

Figure 2:
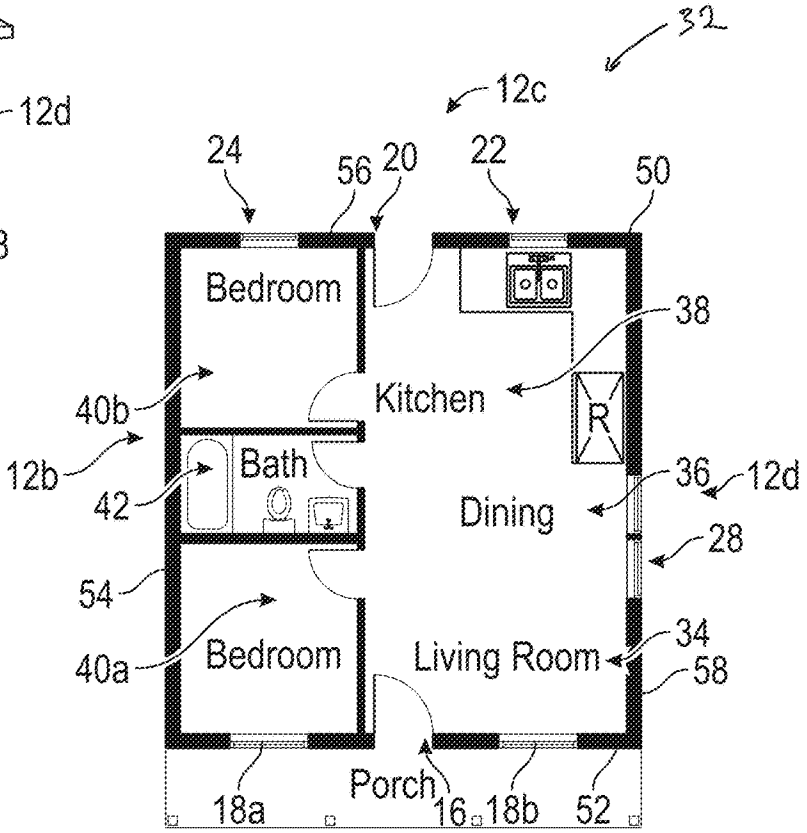
FIG. 2 is a floor plan for the building structure of FIG. 1.

The building plans for the building structure 10 is shown in FIGS. 2-3 and 5-11. Specifically, FIG. 2 shows a floor plan 32 for building structure 10. In this floor plan 32, it can be seen that building structure 10 has four exterior walls 50, which include a front wall 52, a first side wall 54, a rear wall 56, and a second side wall 58. These exterior walls 50 form the exterior of the building structure 10 and allow for the formation of: (i) a living room 34, (ii) a dining room 36, (iii) a kitchen 38, (iv) two bedrooms 40*a*, 40*b*, and (v) one bathroom 42. Additionally, two doors 16, 20 and five windows 18*a*, 18*b*, 22, 24, 28 are formed within said exterior walls 50. As discussed above, this is only a representative structure and the following disclosure can be applied to simpler and more complex structures.

Figure 3:
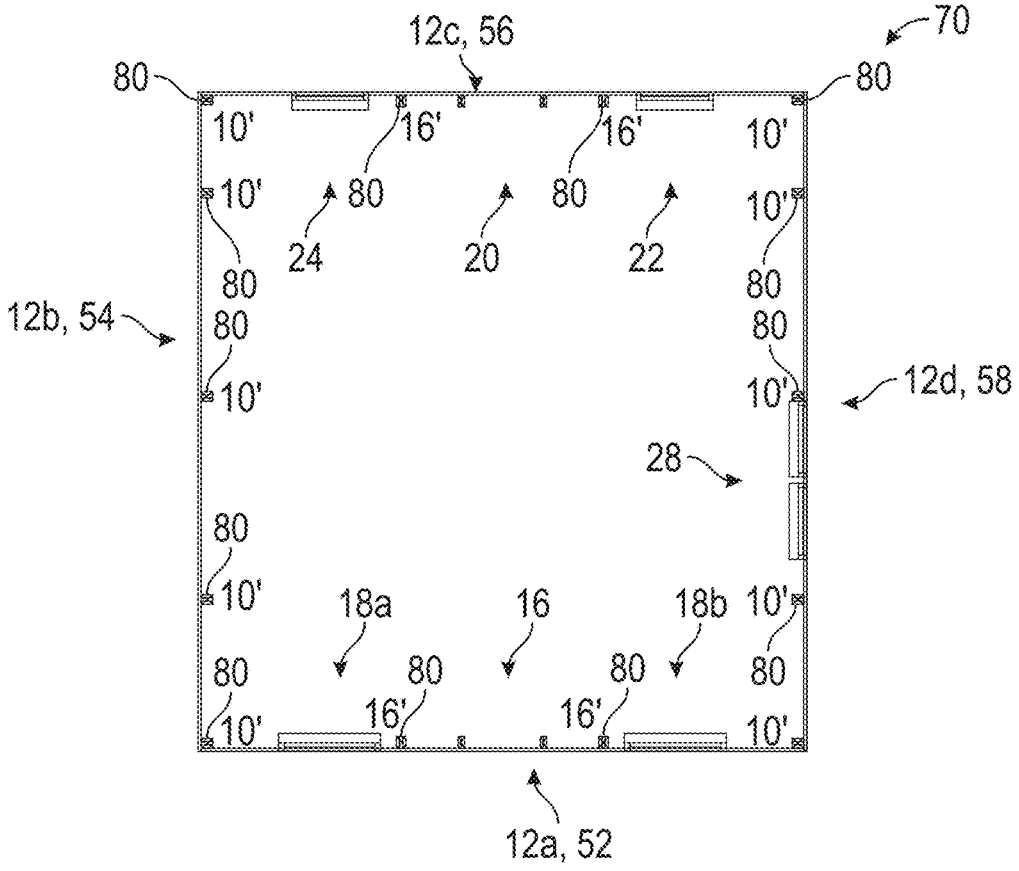
FIG. 3 is a post setting plan for the building structure of FIG. 1, showing the arrangement of posts, walls, windows and doors.
Figure 4:
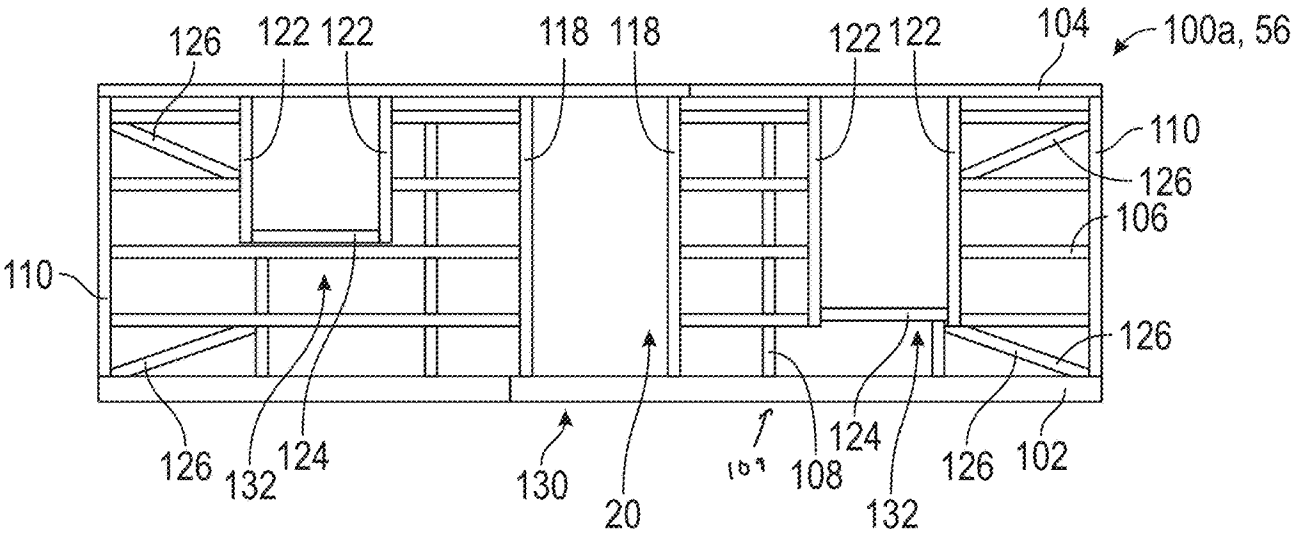
FIG. 4 is a rear wall plan for the building structure of FIG. 1.
Figure 5:
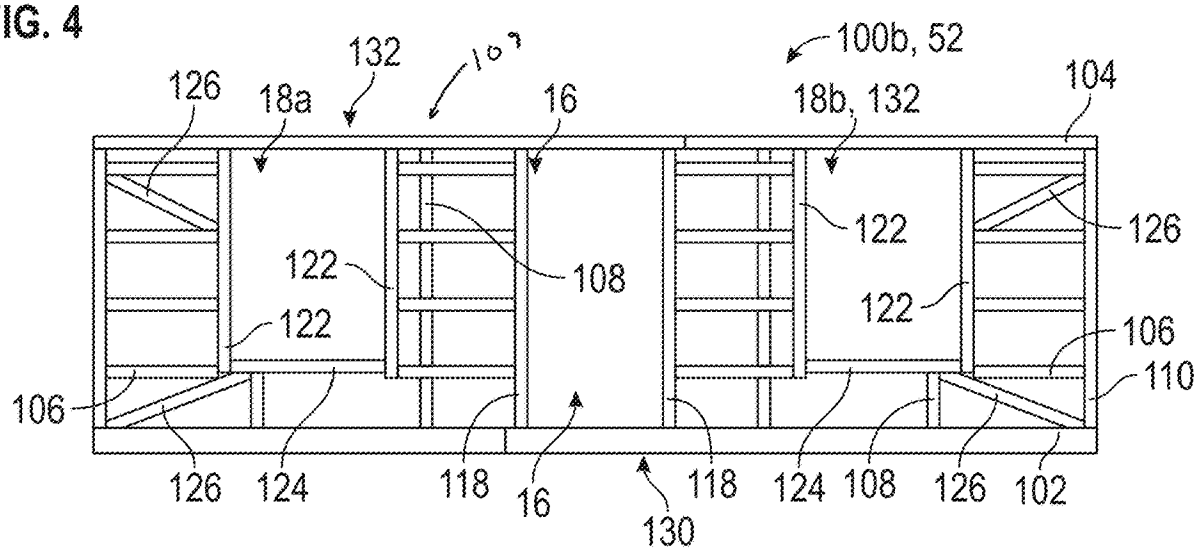
FIG. 5 is a front wall plan for the building structure of FIG. 1.
Figure 6:
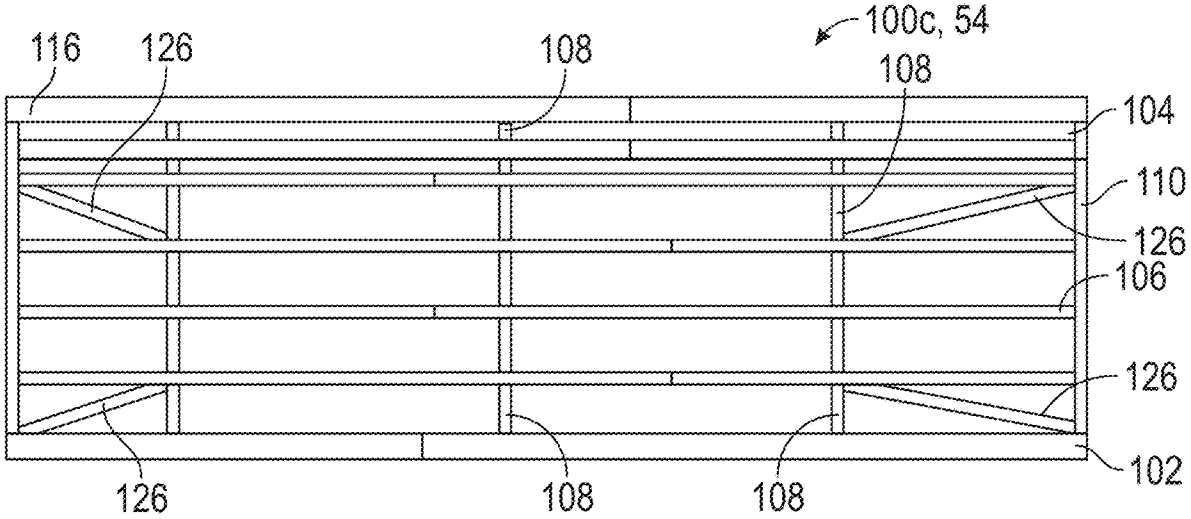
FIG. 6 is a first side wall plan for the building structure of FIG. 1.
Figure 7:
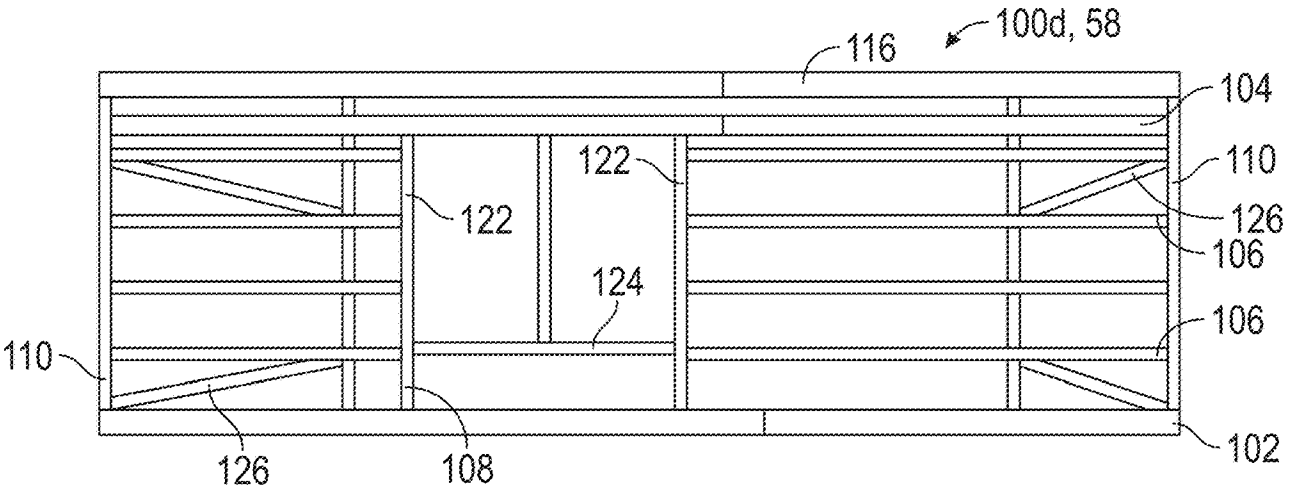
FIG. 7 is a second side wall plan for the building structure of FIG. 1.
Figure 8:
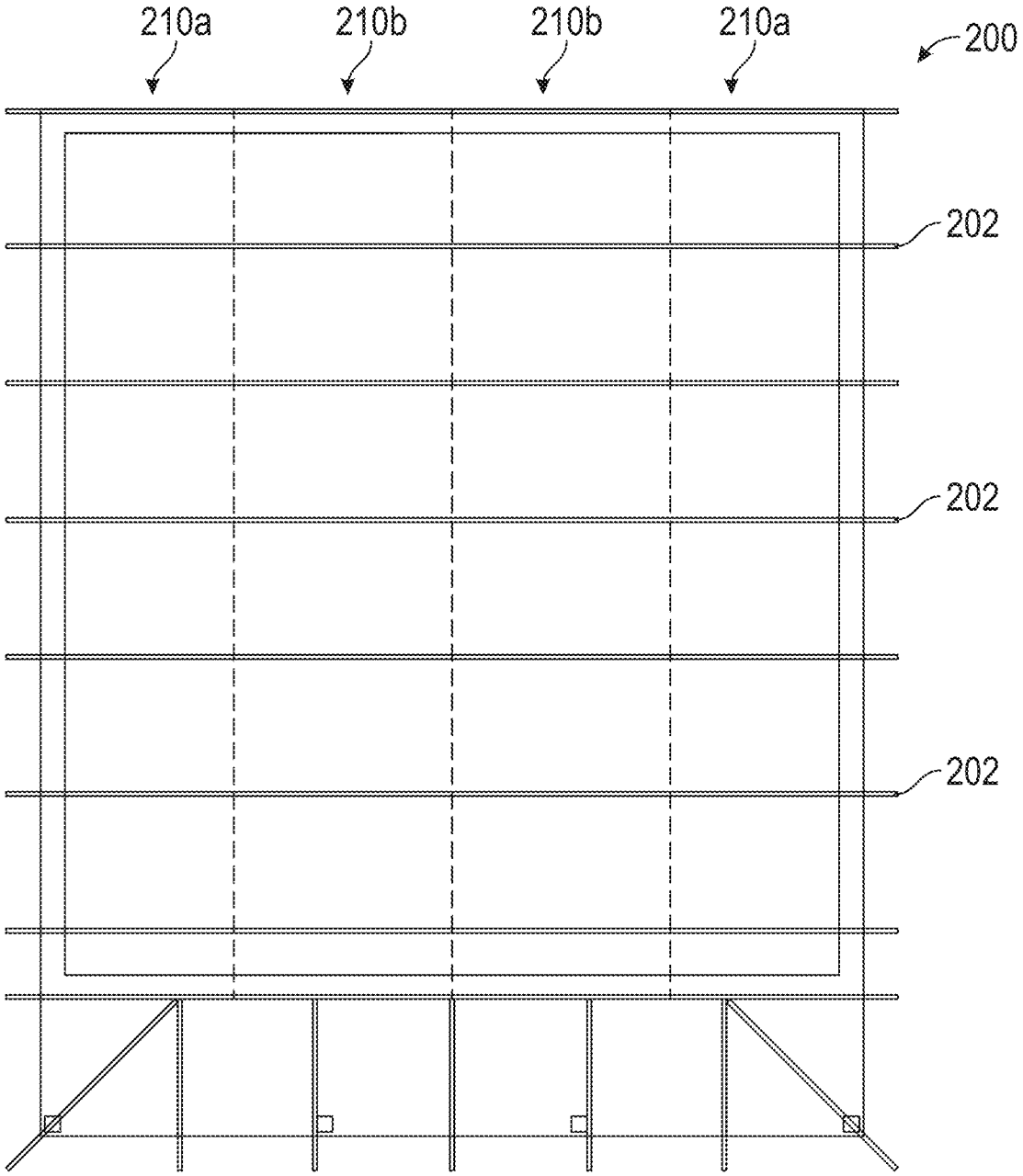
FIG. 8 is a roof layout for the building structure of FIG. 1.
Figure 9:
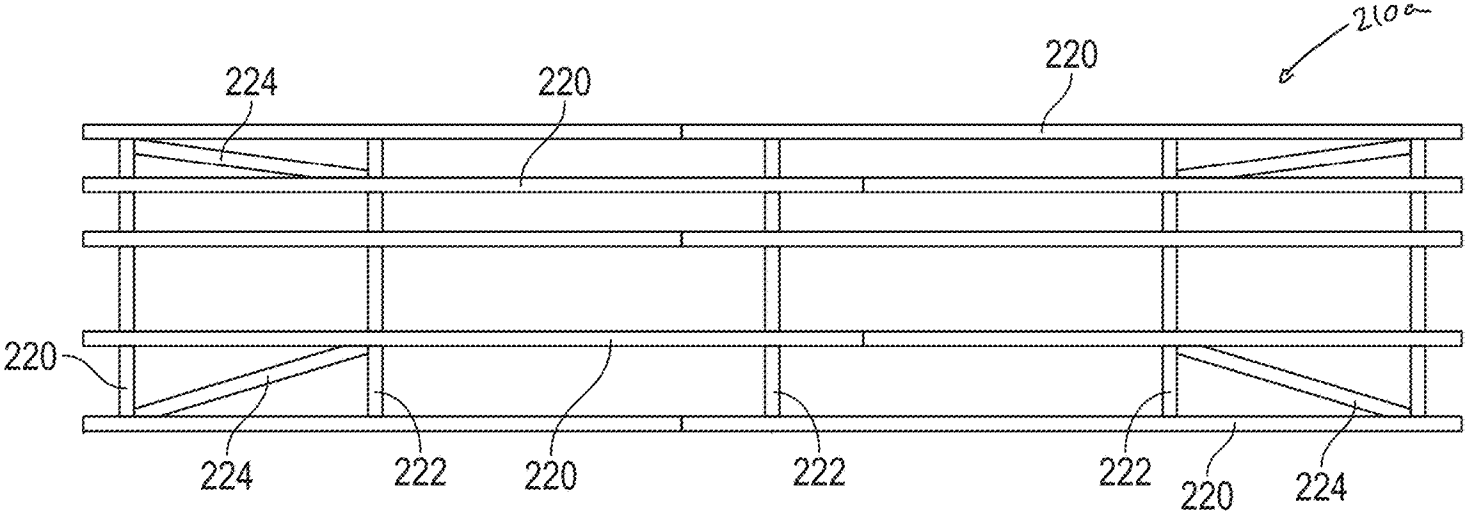
FIG. 9 is a lower roof plan for the building structure of FIG. 1.
Figure 10:
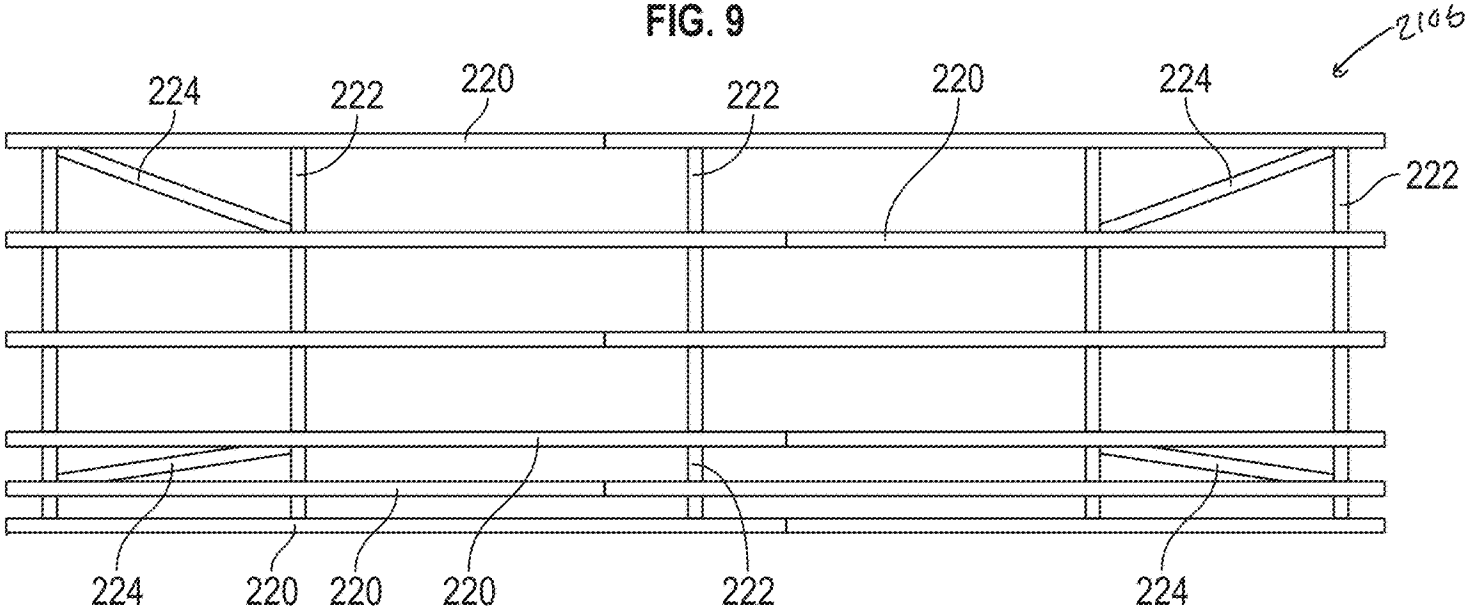
FIG. 10 is an upper roof plan for the building structure of FIG. 1.

Once the floor plan 32 is created, a post setting plan (FIG. 3) 70 can be created. As shown in FIG. 3, the posts 80 are designed to be set on centers that are eight feet or less using the adjustable anchor system. It should be understood that other distances may be used in other building types or structures or the adjustable anchor system may be omitted and the posts 80 may be set in a conventional fashion. From the post setting plan 70, the designer can then generate: (i) the wall layout, and (ii) the roof layout 200. In this embodiment, the wall layout is formed from a plurality of wall plans or vertical section plans 100*a*-100*d* include: (i) a rear wall plan 100*a* (FIG. 4), (ii) a front wall plan 100*b* (FIG. 5), (iii) a first side wall plan 100*c* (FIG. 6), and (iv) a second side wall plan 100*d* (FIG. 7).

Each of the wall plans or vertical section plans 100*a*-100*d* includes at least the following members 101: (i) an elongated horizontal bottom member, bottom girt, skirt member, grade girt or splash plank 102, (ii) an elongated horizontal top member, top girt, cave girder, or cave strut 104, (iii) at least one horizontal girt(s) 106, (iv) two vertical end caps or end members 110. Certain wall plans 100*a*-100*d*, may include the following members 101: (i) a plurality of vertical spacer blocks 108, wherein a series of blocks are typically aligned to form a vertical spacer assembly 109, (ii) an elongated horizontal truss support 116, (iii) a vertical door member or door frame member 118, which typically extends between the elongated horizontal bottom member 104 and the elongated horizontal top member 104, (iv) a door header or door cross-member 120, which typically extends between two vertical door members 118, (v) a vertical window member or window frame member 122, which typically does not extend between the elongated horizontal bottom member 104 and the elongated horizontal top member 104, (vi) a window cross-member 124, which typically extends between two vertical window member 122, and (vii) a bracing member or support 126, which typically extends between: (a) an extent of the elongated horizontal bottom or top member 104, 106, and an end members 110, and (b) an extent of the vertical spacer assembly that is formed from a plurality of vertical spacer blocks 108.

The rear wall plan 100*a* (see FIG. 4) and the front wall plan 100*b* (see FIG. 5) specifically includes: (i) one bottom member 102, (ii) one top member 104, (iii) fourteen horizontal girts 106 arranged to form four substantially linear rows, (iv) thirteen vertical spacer blocks 108, which are arranged to form four vertical spacer assemblies or columns 109, (v) two vertical end members 110, (vi) two vertical door members 118, (vii) four vertical window member 122, (viii) two window cross-members 124, and (ix) four bracing members 126. The two vertical door members 118, bottom member 102, and top member 104 function together to form the door frame 130 for the door 16, 20, while the four vertical window member 122 and two window cross-members 124 function together to form two window frames 132 for the windows 18*a*, 18*b* 22, 24.

The first side plan 100*c* (see FIG. 6) specifically includes: (i) one bottom member 102, (ii) one top member 104, (iii) four horizontal girts 106, (iv) eighteen vertical spacer blocks 108 arranged to form three vertical spacer assemblies or columns, (v) one horizontal truss support 116, and (vi) four bracing members 126. As best shown in this side section 100*b*, the girts 106 are designed to run the length or a substantial length of the wall section 100*c*. In contrast, a conventional stud wall that used utilizes stud members that run the vertical length between the top and bottom plates. As such, the wall plans 100*a*-100*d* may lack a vertical member that extends continuously between the elongated horizontal top member 104 and elongated horizontal bottom member 102. In other words, the arrangement of the elongated structural members utilized in the disclosed wall sections 100*a*-100*d* are rotated by 90 degrees in comparison to conventional elongated structural members contained in a conventional stud wall. Stated another way, the disclosed walls 100*a*-100*d* primarily rely on horizontal girts 106 for strength or rigidity, which is directly opposite of a stud wall that relies primarily on vertical studs for strength. The horizontal orientation of the girts 106, which provide a majority of the wall sections 100*a*-100*d* strength, is desired for walls used in post frame construction because it provides a crisscrossing or waffle arrangement of structural wall members/girts 106 and posts 80. In other words, the girts 106 intersect the post 80 at a 90 degree angle, which provides additional rigidity to the structure 10. This crisscrossing or waffle arrangement of structural wall members/girts 106 and posts 80 is not found in a conventional stud wall because said conventional stud wall is not supports by posts and instead is "directly coupled" to the floor or foundation. Wherein "directly coupled" means a fastener or another structure extends through or around an extent of the stud wall and into the floor or foundation without an intervening structure positioned between the stud wall and the floor or foundation.

The second side plan 100*d* (see FIG. 8) specifically includes: (i) one bottom member 102, (ii) one top member 104, (iii) eight horizontal girts 106 arranged to form four substantially linear columns, (iv) thirteen vertical spacer block 108 arranged to form three vertical spacer assemblies or columns, (v) a horizontal truss support 116, (vi) two vertical window member 122, (vii) one window cross-member 124, and (vi) four bracing members 126. It should be understood that in other embodiments, each of the wall plan 100*a*-100*d* may have other configurations. For example, the front wall 100*a* may have fourteen horizontal girts 106 that are not be arranged to form four linear rows and may have thirteen vertical spacer blocks 108 that are not be arranged to form four vertical spacer assemblies or columns. Instead, this wall 100*a* may include fourteen rows and thirteen vertical spacer assemblies 109 or may include one row and one vertical spacer assembly 109. Further, more or less horizontal girts 106 (e.g., between 1 and 1,000) and vertical spacer block 108 (e.g., between 1 and 1,000) may be used in alternative embodiments.

Figure 14:
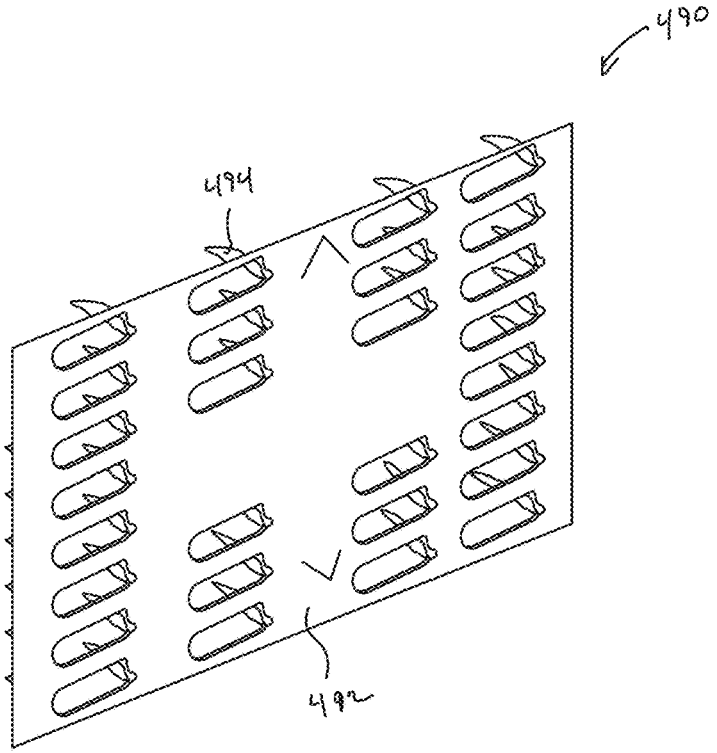
FIG. 14 is a perspective view of a coupling plate using in forming the assemblies of the building structure.

Once the wall plan 100*a*-100*d* are created, a roof layout 200 may be created. This roof layout 200 is shown in FIG. 14 and specifies the layout of the trusses 202 and the roof plans or non-vertical section plans 210. Like the wall plans 100*a*-100*d*, the roof plans 210*a*, 210*b* include: (i) at least one purlin 220, (ii) at least one purlin block 222, and (iii) at least one bracing member 224. In particular, the lower roof plan 210*a* (see FIG. 9) includes: (i) five purlins 220, (ii) 20 purlin blocks 222 arranged to form five columns, and (iii) four bracing members 224. Meanwhile, the upper roof plan 210*b* (see FIG. 10) includes: (i) six purlins 220, (ii) 25 purlin blocks 222 arranged to form five columns, and (iii) four bracing members 224. As discussed above, each of the roof plans 210*a*, 210*b* may have other configurations. For example, the lower roof section 210*a* may have more or less purlins 220 (e.g., between 1 and 1,000) and purlin blocks 222 (e.g., between 1 and 1,000).

2) Designing the Assemblies of the Building Structure

Figure 11:
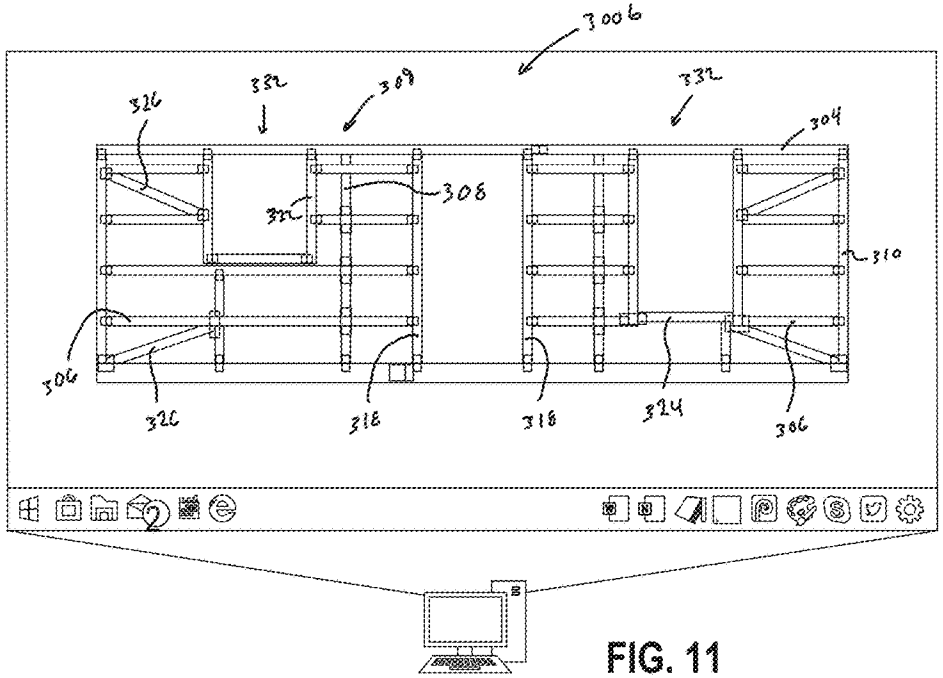
FIG. 11 shows a digital design of the construction system, displaying the rear wall plan for the building structure of FIG. 4.
Figure 12:
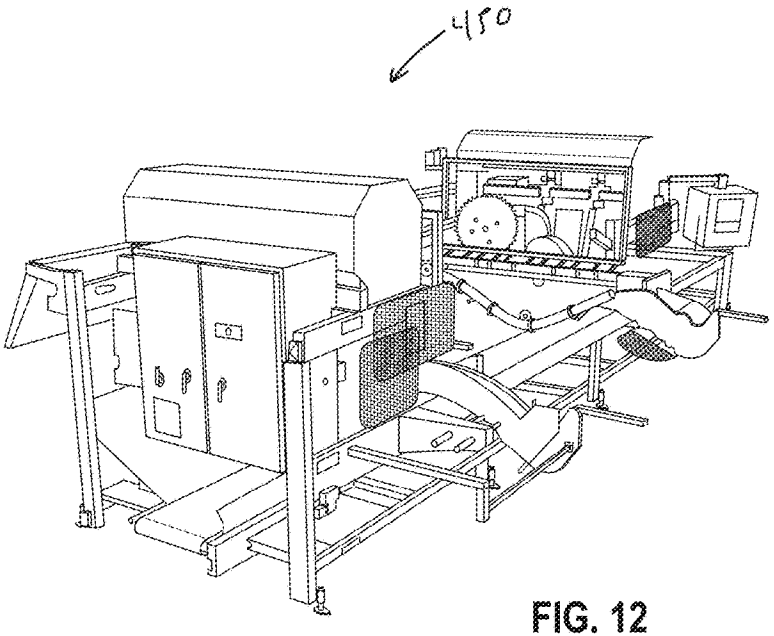
FIG. 12 shows a computer-controlled saw configured to cut stock lumber into job-specific lumber to fabricate the wall assemblies and roof assemblies according to the design plans of the construction system shown in FIGS. 4-7 and 8-10.

Once the traditional plans 100*a*-100*d*, 210*a*, 210*b* are drawn or created, said plans 100*a*-100*d*, 210*a*, 210*b* can be entered into a computer to generate digital plans 300*a*-300*d*, 410*a*, 410*b*. An example of this digital creation is shown in FIG. 11, which displays an image of the rear wall section 300*b*. Because the structures contacted in the digital plans 300*a*-300*d*, 410*a*, 410*b* are the same as the structures contacted in the traditional plans 100*a*-100*d*, 210*a*, 210*b*, it should be understood that reference numbers that are shown in the figures may be omitted from the specification for sake of brevity as like structures have like numbers. For example, the disclosure in connection with vertical spacer assemblies 109 is not repeated herein, but it applies to vertical spacer assemblies 309, as if it were repeated herein. Likewise, it should be understood that disclosure in connection with vertical spacer assemblies 509 also applies to vertical spacer assemblies 109. In other words, omitting reference numbers from the specification or specific disclosure of the functionality of that structure should not limit the disclosure of this application. Instead, one shall refer to the disclosure of similar structures that may be discussed above. The digital creation of the plans 300*a*-300*d*, 410*a*, 410*b* may occur from the start, whereby the generation of the non-digital plans 100*a*-100*d*, 210*a*, 210*b* is skipped or omitted. The digital plans 300*a*-300*d*, 410*a*, 410*b* can be generated in Autocad or any similar computer program. In addition to other benefits, a benefit of building these plans in a digital environment is the fact that their durability and functional design can be digitally tested (e.g., load testing) before manufacturing wall assemblies or roof assemblies accordingly to the plans 300*a*-300*d*, 410*a*, 410*b*. This can save substantial time and helps reduce the potential for errors. While this step is desirable, it should be understood that it may be omitted during the building process is possible.

The digital testing of the wall assemblies 100*a*-100*d* have resulted in the typical inclusion of at least one vertical spacer assembly 109/409 that is comprised of a plurality of vertical spacer blocks 108/408. This vertical spacer assembly 109/409 is beneficial because it: (i) helps ensure that the spaces between the horizontal girts 106/406 remain constant, and (ii) helps provide additional rigidity to wall assemblies 100*a*-100*d*/400*a*-400*d*. Once the length of the wall assemblies 100*a*-100*d*/400*a*-400*d* is over 8 feet, and preferably over 10 feet, at least one vertical spacer assembly 109/409 should be included in the wall assemblies 100*a*-100*d*/400*a*-400*d* to ensure that the physical wall assemblies 500*a*-500*d* are durable enough to be: (i) loaded onto the truck, (ii) brought to the job site, (iii) lifted and positioned against the posts 80 by a machine (e.g., crane), and (iv) fastened to the posts 80. Without the physical vertical spacer assembly 509, the physical wall assemblies 500*a*-500*d* may not be durable enough to withstand the above described activities.

3) Cutting the Lumber for the Assemblies of the Building Structure

The configuration of each member 101 can be entered into a computer controlled saw 450 based upon either the conventional plans 100*a*-100*d*, 210*a*, 210*b* or digital plans 300*a*-300*d*, 410*a*, 410*b*. This saw 450 can take stock lumber and cut it to create the job specific lumber 460 for use in manufacturing the wall and roof assemblies 500*a*-500*d*, 610*a*, 610*b*. Because the structures contacted in the conventional plans 100*a*-100*d*, 210*a*, 210*b* or digital plans 300*a*-300*d*, 410*a*, 410*b* are the same as the structures contacted in the wall and roof assemblies 500*a*-500*d*, 610*a*, 610*b*, it should be understood that reference numbers that are shown in the figures may be omitted from the specification for sake of brevity as like structures have like numbers. For example, the disclosure in connection with vertical spacer assemblies 109, 309 is not repeated herein, but it applies to vertical spacer assemblies 509, as if it were repeated herein. Likewise, it should be understood that disclosure in connection with vertical spacer assemblies 509 also applies to vertical spacer assemblies 109, 309. In other words, omitting reference numbers from the specification or specific disclosure of the functionality of that structure should not limit the disclosure of this application. Instead, one shall refer to the disclosure of similar structures that may be discussed above.

The job specific lumber 460 includes members 501 that are dimensioned (e.g., lengths, widths, and angles) to match the dimensioned (e.g., lengths, widths, and angles) of the members 101 of either the conventional plans 100*a*-100*d*, 210*a*, 210*b* or digital plans 300*a*-300*d*, 410*a*, 410*b*. The members 501 will be utilized to form the physical wall assemblies 500*a*-500*d* and roof assemblies 610*a*, 610*b*. In other words, the job specific lumber 460 includes extents of stock lumber that have been cut to the desired dimensions (e.g., lengths, widths, and angles) based on either the conventional plans 100*a*-100*d*, 210*a*, 210*b* or digital plans 300*a*-300*d*, 410*a*, 410*b*. Once each member 501 is formed, each member 501 is labeled (e.g., QR code or any other indicia) to inform a user or another computerized machine where the member 501 fits in a wall assembly 500*a*-500*d* or roof assembly 610*a*, 610*b*. After labeling, the members 501 that are contained in the job-specific lumber 460 are packed up or moved to the assembly area. Using this computer controlled saw 450 in forming the members 501 is beneficial because it reduces waste, is faster, and utilizes less of the labor force. While using the computer controlled saw 450 or labeling the members 501 is desirable, it should be understood that these steps may be omitted. For example, the labeling of the members 501 may be omitted if the members 501 are cut and directly utilized in the formation of the wall or roof assembly 500*a*-500*d*, 610*a*, 610*b*. Additionally, the use of the computer controlled saw 450 may be replaced with a use/operator use of a conventional skill saw.

4) Manufacturing the Assemblies of the Building Structure

A. Wall Assemblies

Figure 13A:
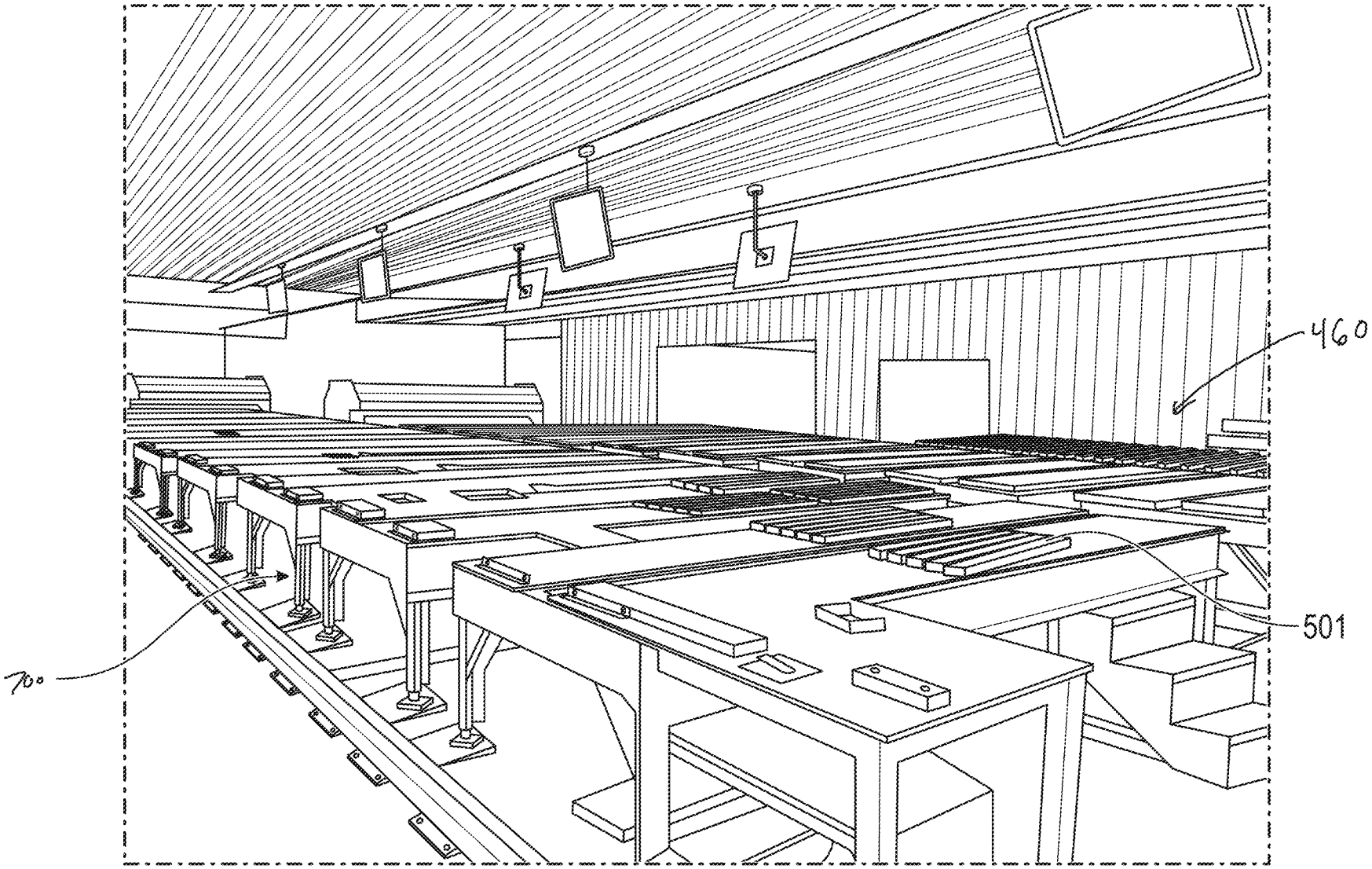
FIG. 13A is a perspective view of a work table with an extent of the job-specific lumber laid thereon.
Figure 13B:
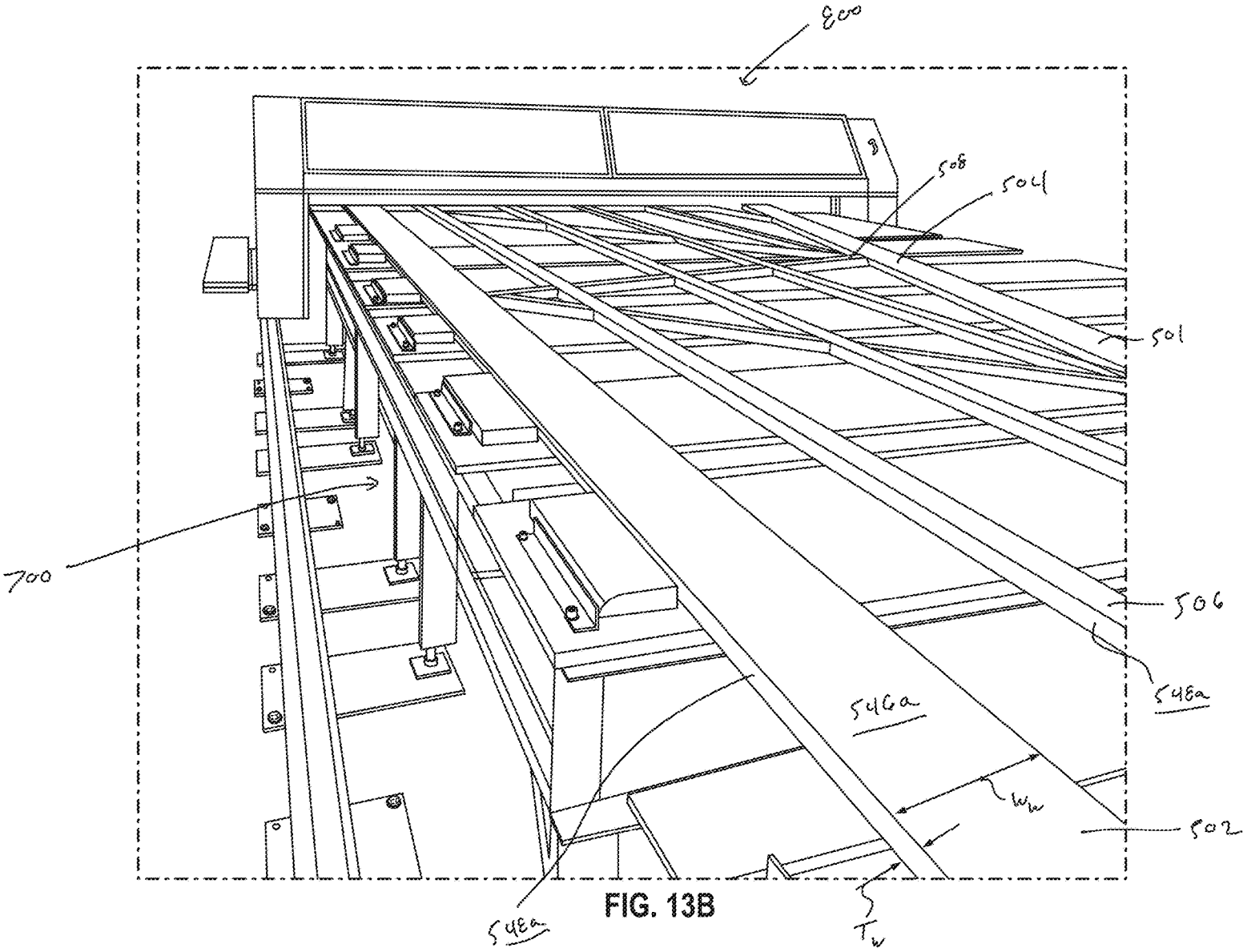
FIG. 13B is a perspective view of a machine used in forming the assemblies of the building structure according to the design plans of the construction system shown in FIGS. 4-7 and 8-10.

After the members 501 contained in the job-specific lumber 460 have been cut, labeled, and shipped/sent to the assembler, the wall assemblies 500*a*-500*d* can be manufactured (see FIGS. 15-18). In particular, the members 501 can be laid out a table 700 (see FIGS. 13A-13B) in a planar or flat orientation according to either the conventional wall plans 100*a*-100*d* or digital wall plans 300*a*-300*d*. After the members 501 are laid out, the wall assemblies 500*a*-500*d* can be formed by coupling together the members 501 using the coupling means 490, which may be a coupling plate 492, a metal support bracket, or any other similar coupling method. In particular, a machine 800 can be used to efficiently couple the members 501 to one another using the coupling plates 492. Once the members 501 are coupled to one another, then the wall assemblies 500*a*-500*d* are manufactured and can be further labeled and loaded onto a truck for delivery to a second location or the job site. It should be understood that this step may be altered or specific aspects of this step can be omitted.

Figure 15:
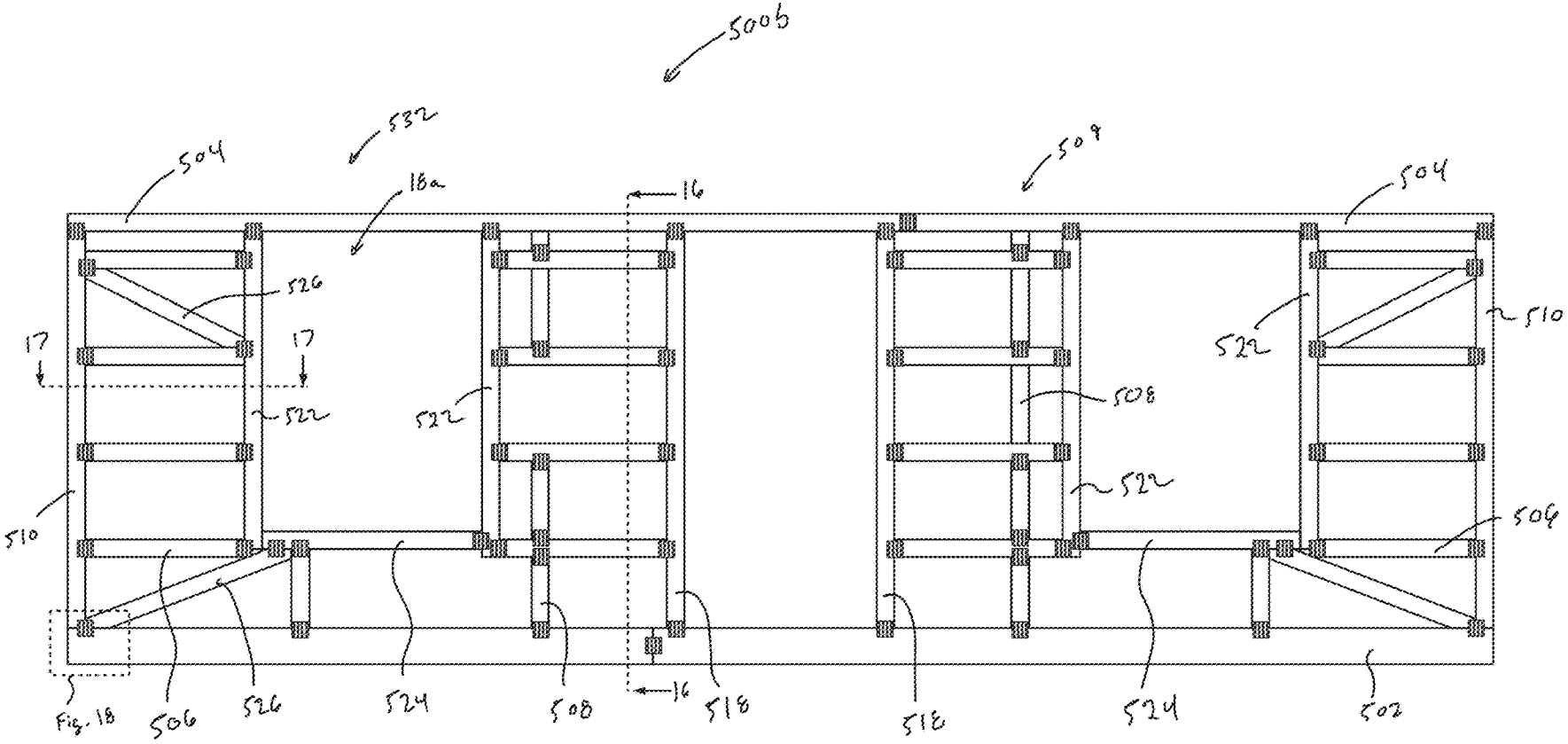
FIG. 15 is a front wall assembly built according to the front wall design plan of the construction system shown in FIG. 5.
Figure 17:
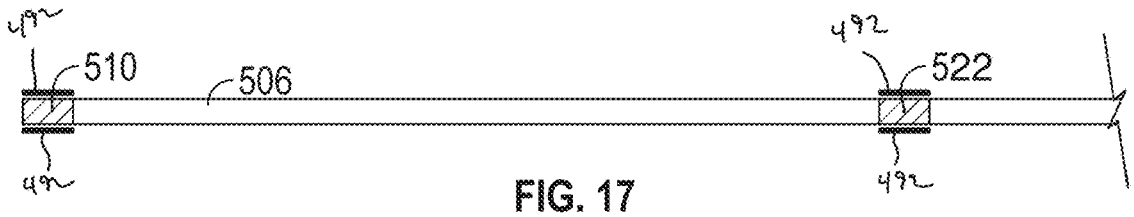
FIG. 17 is a partial horizontal cross-sectional view of the front wall assembly taken along line 17-17 of FIG. 15.
Figure 16:
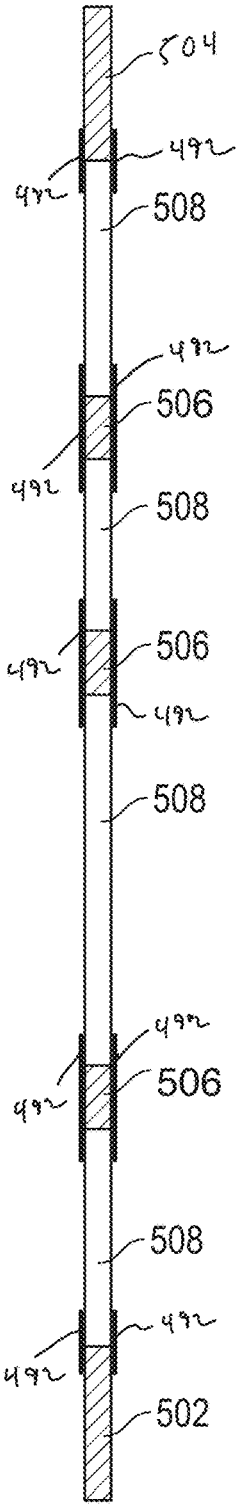
FIG. 16 is a vertical cross-sectional view of the front wall assembly taken along line 16-16 of FIG. 15.
Figure 18:
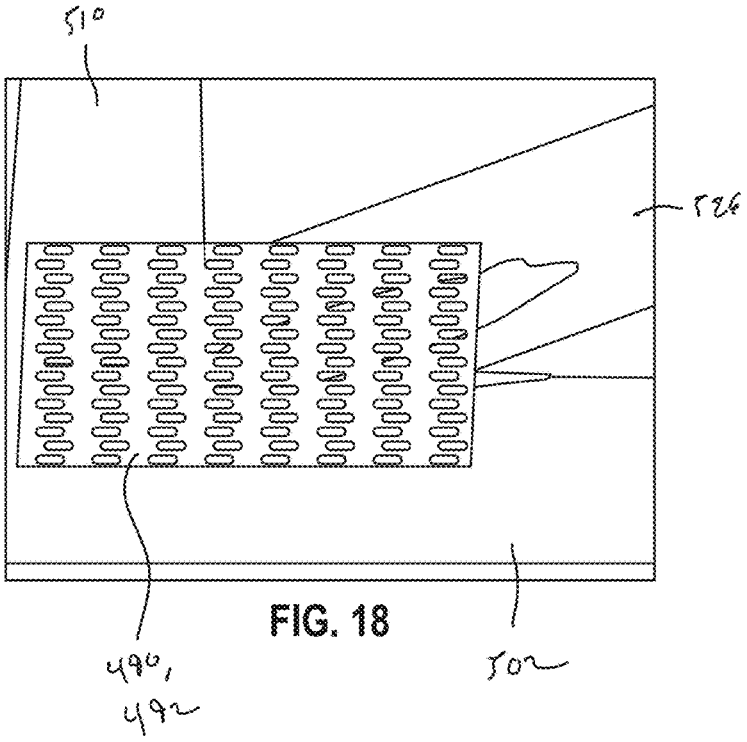
FIG. 18 is a zoomed-in view of the front wall assembly shown in FIG. 15.

Unlike a conventional stud wall used in a building built using a stick frame construction method, the members 501 of the wall sections 500*a*-500*d* are coupled to one another in a planar or flat orientation (not on edge). In other words and each member 501 has: (i) a thickness $T_W$ that extends between a top surface 546*a* and a bottom surface 546*b*, and (ii) a width $W_W$ that extends between a first edge 548*a* and a second edge 548*b*. The width of the member 501 is larger than the thickness of the member 501. As shown in FIGS. 15-17, the top surface 546*a* or bottom surfaces 546*b* (namely, the widest part of each member 501) are laid flat on a table 700 and a coupling means 490, which may be a coupling plate 492, is positioned over the join between the members 501. Stated another way, the coupling means 490 is not driven in through an extent of a member into another member; instead, the coupling means 490 overlaps extents of both members 501 at a joint and the projections 494 are driven into the members 501 at a substantially equal depth. This design creates wall assemblies 500*a*-500*d* with a thickness $T_W$ of about 1.75 inches. In contrast, a convention stud wall has a thickness of about 3.5 inches or 5.5 inches. This reduction in the thickness of the wall assemblies 500*a*-500*d* is desired because it allows the wall assemblies 500*a*-500*d* to be secured to the posts 80 using conventional fasteners, such as a structural screw or a 16 penny nails have a length of 3.5 inches. The conventional stud wall has a thickness of about 3.5 inches or 5.5 inches, which is not desirable for use in a post frame built structure because said conventional stud wall cannot be easily, quickly, and securely attached to the post with conventional fasteners. For example, 16 penny nail cannot penetrate the entire 3.5 or 5.5 inches thickness of the conventional stud wall to secure said wall to the post 80. Additionally, the use of the coupling means 490, which may be a coupling plate 492, is beneficial because the construction of said wall assemblies 500*a*-500*d* can be simplified, performed by a machine, and does not require individual fasteners to be driven through an extent of the adjacent member 501.

Figure 40:
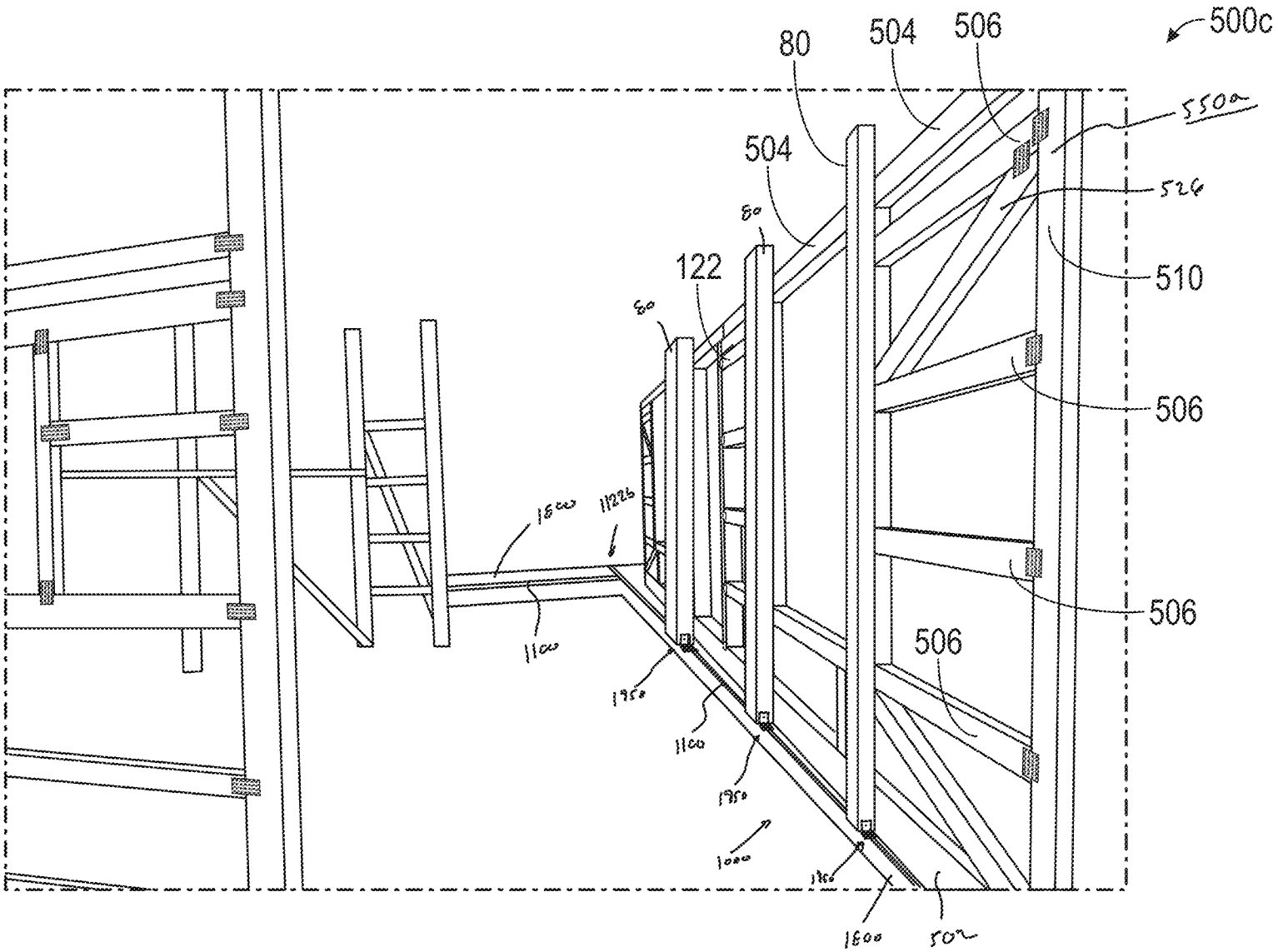
FIG. 40 is a perspective view from a job site where: (i) posts have been secured to the portion of the building support footer assembly according to FIG. 3, and (ii) one of the wall assemblies is attached to said post.
Figure 41:
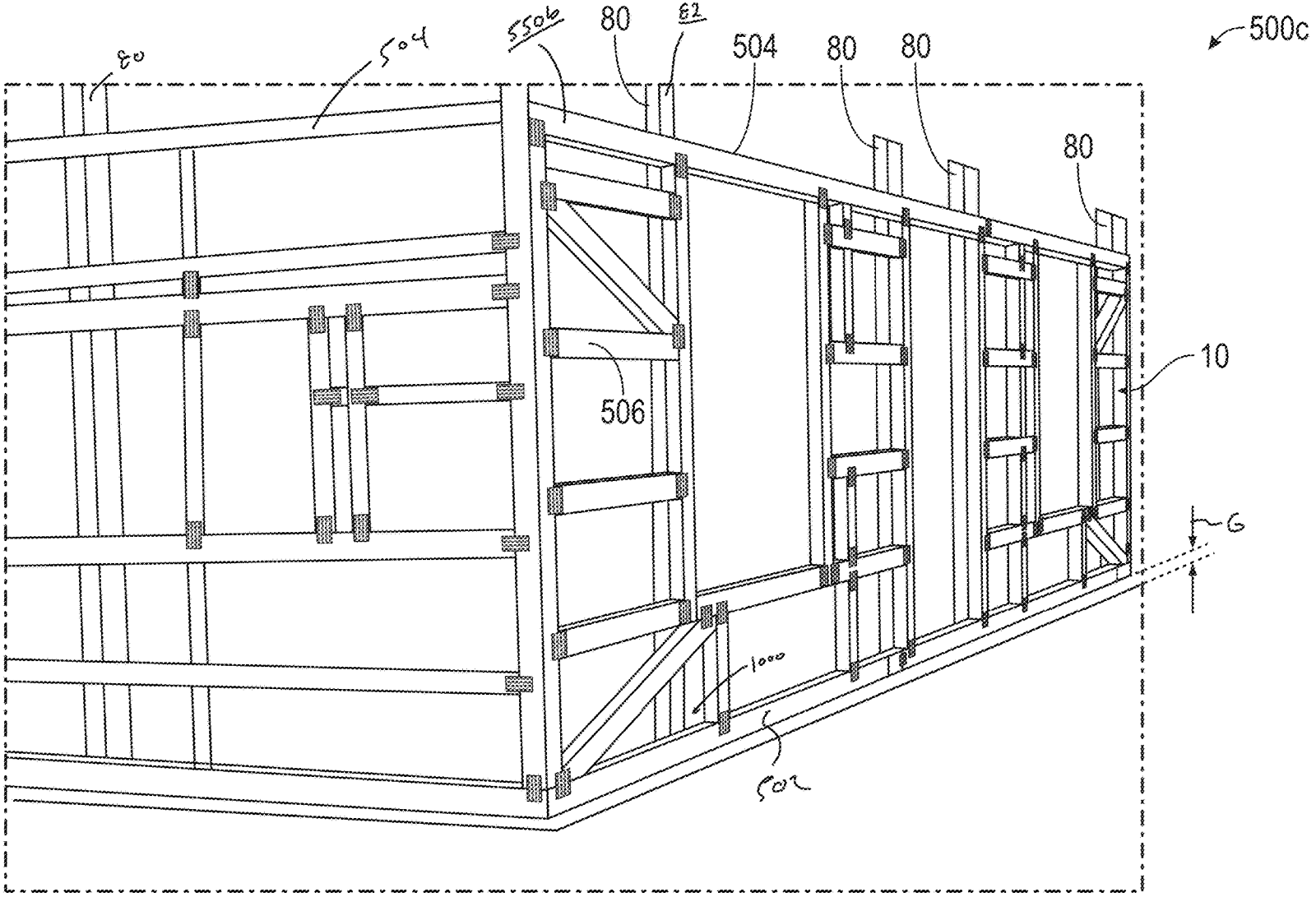
FIG. 41 is a perspective view from the job site showing two wall assemblies have been attached to said posts.

Further, unlike a conventional stud wall used in a building built using a stick frame construction method, the wall assemblies 500*a*-500*d* are suspended or floating over the floor or foundation. This is because the wall assemblies 500*a*-500*d* are not directly fastened to and supported by the foundation. Instead, wall assemblies 500*a*-500*d* are directly fastened to the posts 80, and said posts 80 support the wall assemblies 500*a*-500*d*. Due to the positional arrangement of the posts 80 and wall assemblies 500*a*-500*d*, a gap G is formed between the lowermost extent of the wall assemblies 500*a*-500*d* and the uppermost extent of the floor, ground, or foundation. As shown in FIGS. 40-41, the gap G may be between 0.25 inches and 12 inches above the floor, ground, or foundation. This suspended or floating framing system 1 is beneficial because: (i) it does not require a foundation under the wall assemblies 500*a*-500*d*, and (ii) reduces cost and the labor associated with fastening the walls to the foundation. Moreover, unlike a conventional stud wall or other conventional prefabricated walls, the wall assemblies 500*a*-500*d* typically include a plurality of vertical spacer blocks 508 that are aligned to form a vertical spacer assembly 509. In contrast the disclosed the wall assemblies 500*a*-500*d*, a conventional stud wall does not use vertical spacer assemblies because most, if not all, of the studs contained in a conventional stud wall run the vertical height of the wall. In other words, the studs are coupled to the top and bottom of the wall and there are no horizontal members that run the length of the conventional stud wall.

B. Roof Assemblies

Figure 19:
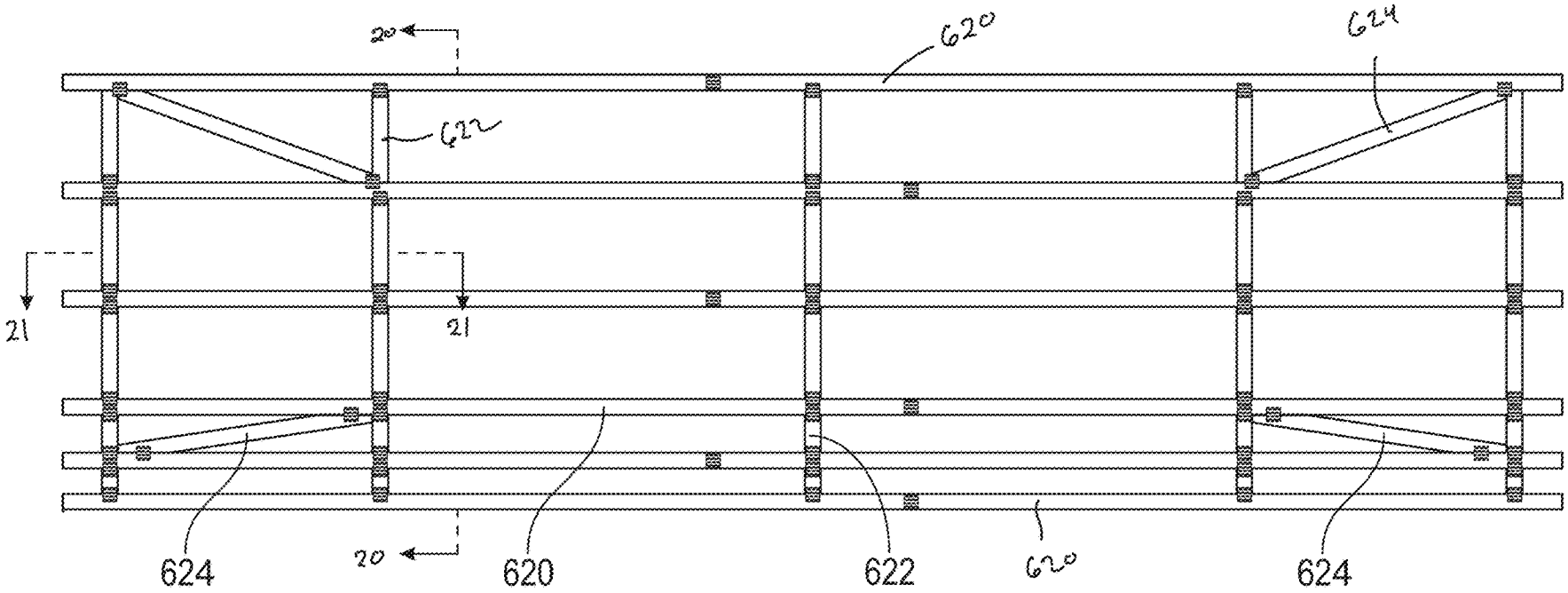
FIG. 19 is a upper roof assembly built according to the upper roof plan of the construction system shown in FIG. 10.
Figure 20:
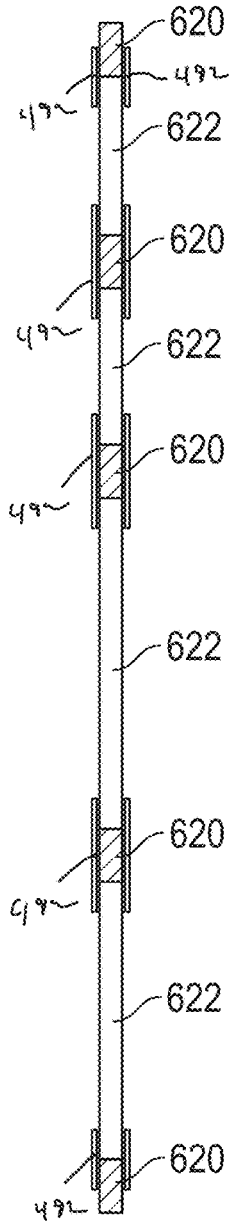
FIG. 20 is a vertical cross-sectional view of the upper roof assembly taken along line 18-18 of FIG. 19.
Figure 21:
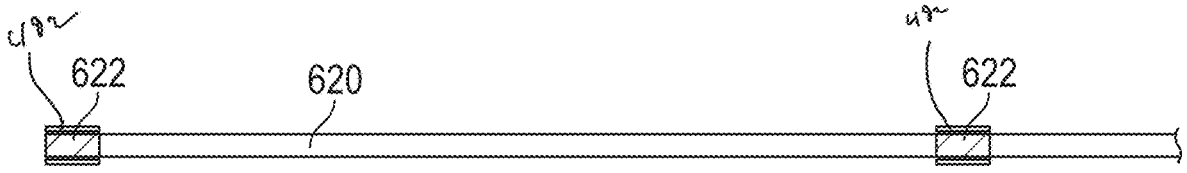
FIG. 21 is a partial horizontal cross-sectional view of the upper roof assembly taken along line 21-21 of FIG. 19.

After the members 501 contained in the job-specific lumber 460 have been cut, labeled, and shipped/sent to the assembler, the roof assemblies 610*a*, 610*b* can be manufactured (see FIGS. 19-21). Like the wall assemblies 500*a*-500*d*, the members 501 can be laid out a table 700 (see FIGS. 13A-13B) in a planar or flat orientation according to either the conventional roof plans 210*a*, 210*b* or digital roof plans 410*a*, 410*b*. After the members 501 are laid out, the roof assemblies 610*a*, 610*b* can be formed by coupling together the members 501 using the coupling means 490, which may be a coupling plate 492, a metal support bracket, or any other similar coupling method. In particular, a machine 800 can be used to efficiently couple the members 501 to one another using the coupling plates 492. Once the members 501 are coupled to one another, then the roof assemblies 610*a*, 610*b* are manufactured and can be further labeled and loaded onto a truck for delivery to a second location or the job site. It should be understood that this step may be altered or specific aspects of this step can be omitted.

Unlike a conventional roof of a building built using stick frame construction method, the members 501 of the roof assemblies 610*a*, 610*b* are coupled to one another in a planar or flat orientation (not on edge). In other words and as shown in FIGS. 19-21, the widest part of each member 501 is laid flat on a table 700 and a coupling means 490, which may be a coupling plate 492, is positioned over the join between the members 501. Stated another way, the coupling means 490 is not driven in through an extent of a member into another member; instead, the coupling means 490 overlaps extents of both members 501 at a joint and the projections 494 are driven into the members 501 at a substantially equal depth. This design creates roof assemblies 610*a*, 610*b* with a thickness $T_W$ of about 1.75 inches. In contrast, a conventional roof has a thickness that is about 3.5 inches or 5.5 inches. This reduction in the thickness of the roof assemblies 610*a*, 610*b* is desired because it allows the roof assemblies 610*a*, 610*b* to be secured to the trusses 202 using conventional fasteners, such as a structural screw or a 16 penny nails have a length of 3.5 inches. The conventional roof has a thickness of about 3.5 inches or 5.5 inches, which is not desirable because said conventional roof cannot be easily, quickly, and securely attached to the trusses 202 with conventional fasteners. For example, 16 penny nail cannot penetrate the entire 3.5 or 5.5 inches thickness of the conventional roof to secure said roof to the truss 202. Additionally, the use of the coupling means 490, which may be a coupling plate 492, is beneficial because the construction of said roof assemblies 610*a*, 610*b* can be simplified, performed by a machine, and does not require individual fasteners to be driven through an extent of the adjacent member 501.

5) Installing the Posts of the Building Structure

Figure 22:
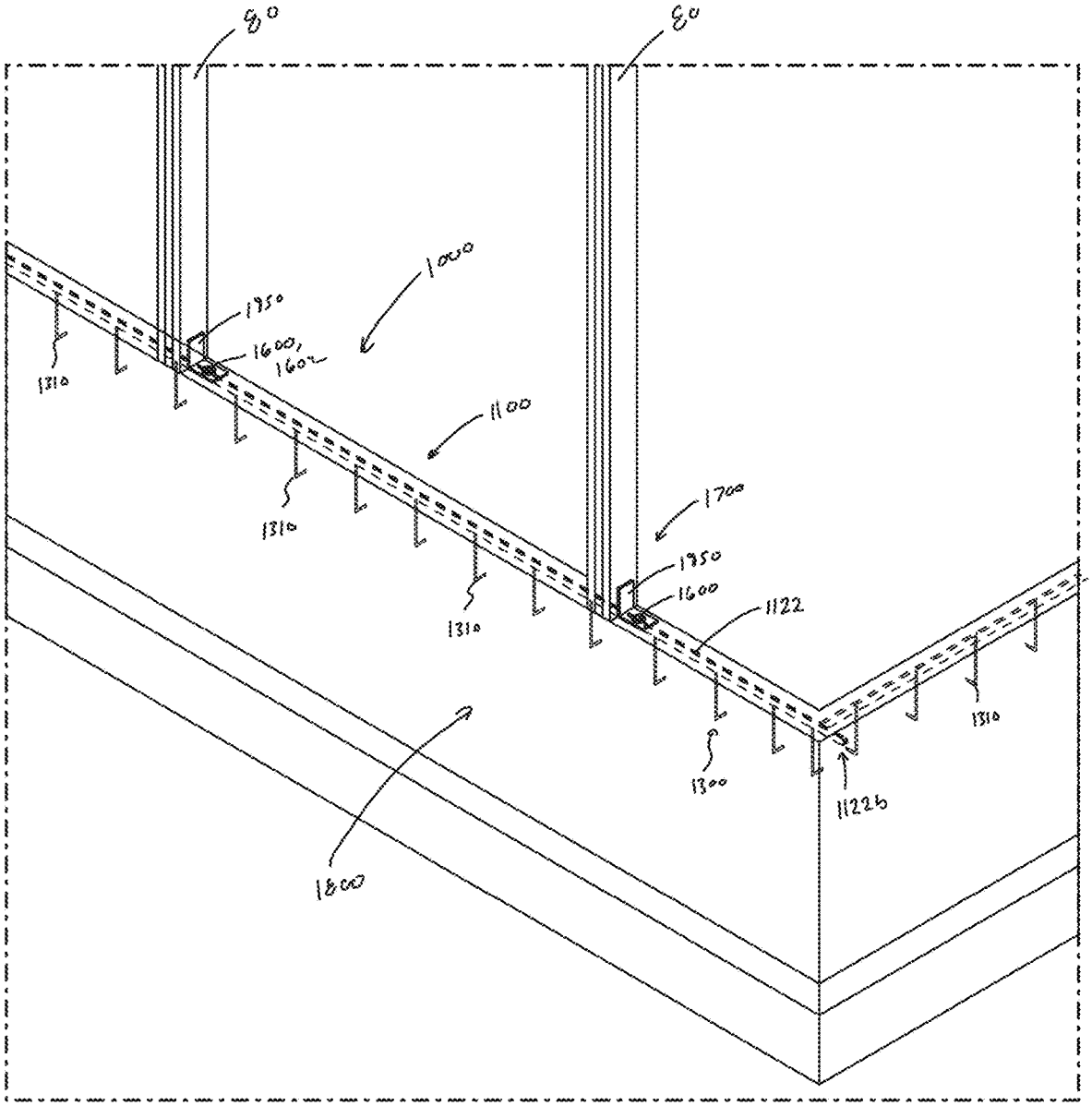
FIG. 22 is a perspective view of an extent of the building structure built according to the post setting plan of the construction system shown in FIG. 3, wherein the building support footer assembly is shown as transparent in order to show an extent of an adjustable anchor system installed therein.

While the wall and roof assemblies 500*a*-50*d*, 610*a*, 610*b* are being fabricated, the builder, including the construction crew, can set the posts 80 according to the post setting plan. The builder may set said posts 80 using a conventional method or an inventive anchoring system 1000 that allows for the adjustable positioning and securement of the posts 80. The conventional method of setting posts typically involves digging a hole, poring a footing in said hole, and then attaching the post 80 to said footing. This conventional method has a number of drawbacks relating to the fact that the post 80 is permanently set whereby the post 80 cannot be moved or repositioned after it has been set. The inventive adjustable anchoring system 1000 disclosed herein overcomes these drawbacks and other numerous other drawbacks by functioning or interacting with the building support assembly 1700 to secure a post 80 in a desired location which can be altered or repositioned (see FIG. 22), as necessary. The inventive adjustable anchoring system 1000 is generally comprised of a track assembly 1100, a securing element 1500, and a fastener assembly 1600.

A. Adjustable Anchor System i. Track Assembly

As shown in FIGS. 23-38, the track assembly 1100 is designed to be installed within a footer 1800 and includes: (i) a least one rail 1110, and preferably two rails 1110*a*, 1110*b*, (ii) a connecting assembly 1200, and (iii) a retaining assembly 1300. The first and second rails 1110*a*, 1110*b* are elongated members that are designed to structurally mate with one another to form a channel 1122 that is configured to slidingly receive the securing element 1500 but not allow for rotation of the securing element 1500, as discussed below. It is desirable to form the channel 1122 from two substantially identical components (i.e., rails 1110*a*, 1110*b*) because it simplifies formation of the channel 1122, ensures the accuracy of the resulting channel 1122, reduces the probability the track assembly 1100 could be damaged during transport to the job site, reduces the need for specialized components or installation procedures, and makes sourcing the components easier. It should be understood that in other embodiments, the separate and distinct rails 1110*a*, 1110*b* may be integrally formed with one another to create a single structure with a continuous wall arrangement forming the channel 1122.

Figure 26:
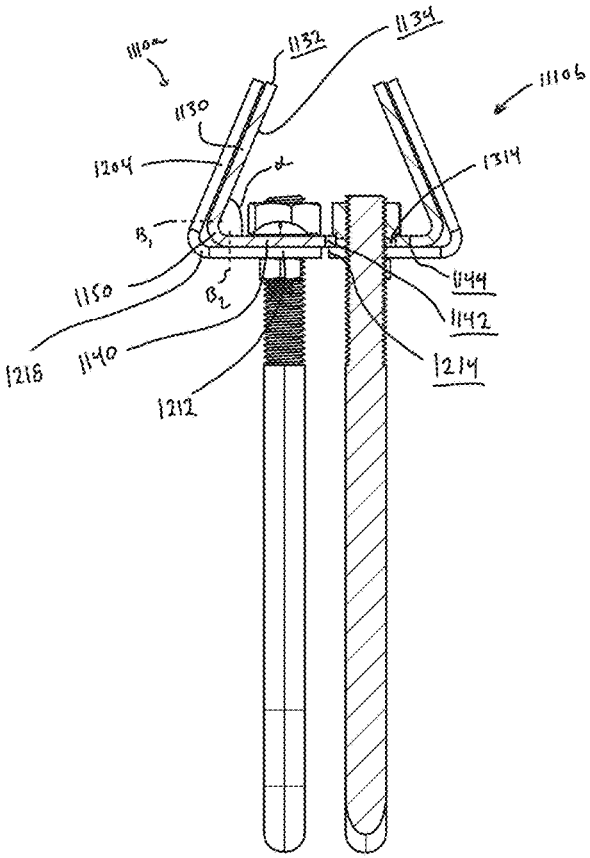
FIG. 26 is a first cross-sectional view of the track assembly taken along line 26-26 of FIG. 25, wherein the cross-section is taken through the opposed rails and the retaining assembly.

The first and second rails 1110*a*, 1110*b* have: (i) a first or side wall 1130 with an upper surface 1132, (ii) a second or bottom wall 1140 with an abutting surface 1142, and (iii) a curvilinear portion 1150 integrally formed with the first and second wall 1130, 1140 and configured to allow the first wall 1130 to be angularly positioned relative to the second wall 1140. As a result, the first and second rails 1110*a*, 1110*b* have a cross-sectional "V-shaped" configuration. Specifically and as shown in FIG. 26: (i) the first wall 1130 extends from the upper surface 1132 to a first rail line $B_1$, includes an inner surface 1134, and has a substantially linear configuration, (ii) the curvilinear portion 1150 extends between the first and second rail lines $B_1$, $B_2$ and has an inner surface 1154, and (iii) the second wall 1140 extends from the second rail line $B_2$ to the abutting surface 1142, includes an inner or upper surface 1144, and has a substantially linear configuration. It should be understood that in other embodiments, the walls 1130, 1140 of the first and second rails 1110*a*, 1110*b* may have a combination of curvilinear components and linear components, or may have one or more curvilinear components.

The first and second walls 1130, 1140 are angularly positioned relative to one another, wherein an interior angle alpha $\alpha$ extends between the inner surface 1134 of the first wall 1130 and the inner surface 1144 of the second wall 1140. The interior angle alpha $\alpha$ is between 20 and 130 degrees, preferably between 40 and 100 degrees, and most preferably 65 degrees. In other words, the interior angle alpha $\alpha$ is a "significant acute angle," which means that the angle is greater than 60 degrees, but less than 80 degrees. It is desirable to utilize an interior angle alpha $\alpha$ that is less than 80 degrees, because this configuration helps ensure that an extent of the rails 1110*a*, 1110*b* are positioned over and under the securing element 1500 without including additional walls. Further and as described below in detail, this configuration is also desirable because it causes an extent of the footer 1800 to be positioned above the first wall 1130 which stabilizes and increases retention of the rails 1110 in the footer 1800. Nevertheless, it should be understood that in alternative embodiments, the interior angle alpha $\alpha$ may be equal to or greater than 90 degrees. In these alternative embodiments, additional walls (e.g., a top wall) may be included in the first and second rails 1110*a*, 1110*b* to help retain the securing element 1500 within the channel 1122.

Figure 27:
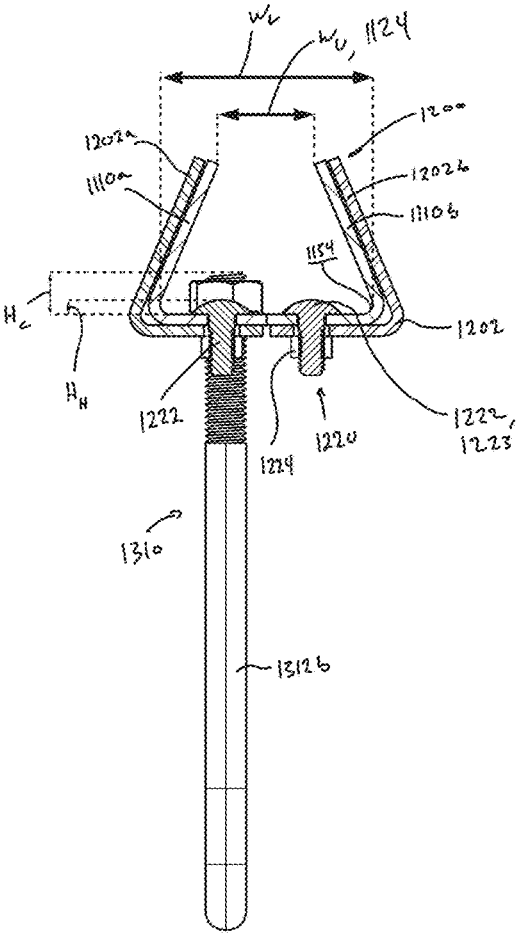
FIG. 27 is a second cross-sectional view of the track assembly taken along line 27-27 of FIG. 25, wherein said cross-section is taken through the opposed rails and the connecting assembly.

As best shown in FIGS. 26 and 27, the channel 1122 has a substantial trapezoidal cross-sectional shape due to the sloped arrangement of the first and second walls 1130, 1140. This shape provides a lower channel width $W_L$ ($W_L$, is between 2 inches and 2.5 inches, preferably 2.25 inches) that is larger than an upper channel width $W_U$ ($W_U$ is between 0.75 inch and 1.75 inches, preferably 1.25 inches) at the mouth 1124 of the channel 1122, which means the channel width W tapers from the lower to upper channel portions. This arrangement of the upper and lower channel widths $W_U$, $W_L$ prevents the securing element 1500 from being inserted or removed from the channel 1122 using an upwardly/downwardly directed force $F_U$, $F_D$. Instead, the only way the securing element 1500, can be instead or removed from the channel 1122 is by inserting or removing said securing element 1500 from an end 1122*a*, 1122*b* of the channel 1122. As discussed in detail below, this insertion/removal requirement complicates use of the securing elements 1500 because they either need to be inserted prior to forming said channel 1122 in the footing 1800 or the end 1122*a*, 1122*b* of the channel 1122 needs to be accessible for insertion of the securing elements 1500 after the channel 1122 is formed in the footing 1800. In other embodiments, the cross-sectional shape of the channel 1122 may have other shapes (e.g., circular, rectangular, oval, parallelogram, trefoil, triangular, a pentagonal, a hexagonal, octagonal, or any other similar polygon).

As best shown in FIGS. 24-27, the connecting assembly 1200 is designed to couple two vertically adjacent rails 1110*a*, 1112*a*, and 1110*b*, 1112*b* together to extend the length of the channel 1122. The connecting assembly 1200 includes braces 1202*a*, 1202*b* and a coupling mechanism 1220. The brace 1202*a*, 1202*b* is designed to be positioned adjacent to an outer surface of the rails 1110*a*, 1110*b*, 1112*a*, 1112*b* and includes (i) a first or side wall 1204, (ii) a second or bottom wall 1212 with an abutting surface 1214, and (iii) a curvilinear portion 1218 integrally formed with the first and second wall 1204, 1212. Specifically and as shown in FIGS. 26 and 27: (i) the first wall 1204 extends from the upper surface to a first rail line $B_1$, includes an inner surface 1206, and has a substantially linear configuration, (ii) the curvilinear portion 1218 extends between the first and second rail lines $B_1$, $B_2$, and (iii) the second wall 1212 extends from the second rail lines $B_2$ to the abutting surface 1214, includes an inner surface 1216, and has a substantially linear configuration. It should be understood that in other embodiments, the brace 1202*a*, 1202*b* of the connecting assembly 1200 may have other configuration that substantially match the configurations of the rails 1110*a*, 1110*b*.

As described above and shown in FIGS. 26, 27, and 29, the track assembly 1100 is formed from two separate rails 1110*a*, 1110*b*. These rails separate rails 1110*a*, 1110*b* are not connected to one another. Instead, during installation of the system 1000 in the footing 1800, the track assembly 1100 is coupled to the form using the securing element 1500. Due to the cross-sectional shapes of the securing element 1500 and the channel 1122, the two separate rails 1110*a*, 1110*b* staying together. Once the track assembly 1100 is installed in the footing 1800, the footing 1800 will keep the separate rails 1110*a*, 1110*b* in an abutting positional relationship to form the channel 1122. Nevertheless, in another embodiment, the separate braces 1202*a*, 1202*b* may be integrally formed with one another to create a single component. The use of a single component may be desirable because will not only perform the above described functions, but it will also couple two laterally adjacent rails 1110*a*, 1110*b* together to form the channel 1122. By coupling two laterally adjacent rails 1110*a*, 1110*b* together, the installer does not have to rely on the cross-sectional shapes of the securing element 1500 and the channel 1122 to keep these components together during installation. Minimizing the possibility that the rails 1110*a*, 1110*b* may separate from one another during installation will reduce a potential failure mode and can increase the usability of the system 1000.

Figure 29:
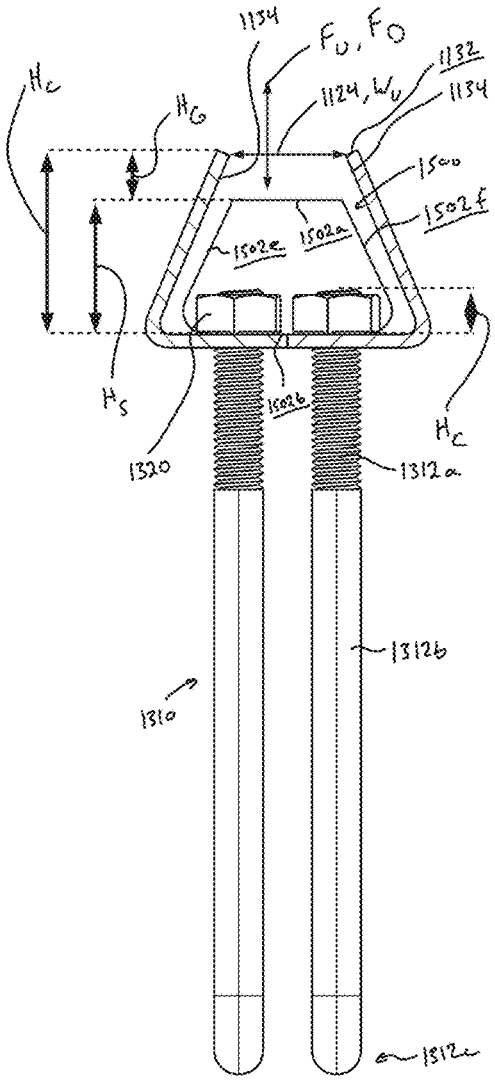
FIG. 29 is a cross-sectional view of the track assembly taken along line 29-29 of FIG. 28 showing an extent of the opposed rails, the securing element and two retaining assemblies.

FIG. 27 shows the securement of the two vertically adjacent rails 1110*a*, 1112*a*, and 1110*b*, 1112*b* using the coupling mechanism 1220, wherein the coupling mechanism 1220 includes at least one bolt 1222 and at least one nut 1224. Here, an extent of the bolts 1222 are positioned within the channel 1122, the nuts 1224 are positioned below the second or bottom wall 1140 of the rails 1110*a*, 1110*b*, and an extent of the bolt 1222 extends through openings formed in the bottom wall 1140 of the rails 1110*a*, 1110*b* and the bottom wall 1212 of the brace 1202*a*, 1202*b*. By positioning the head 1223 of the bolt 1222 within the channel 1122, a portion of the channel 1122 is obscured and the securing element 1500 must move vertically upward in the channel 1122 to overcome said head 1223 of the bolt 1222 in order to move from being positioned in the channel 1122 formed by rails 1110*a*, 1110*b* to being positioned in the channel 1122 formed by rails 1112*a*, 1112*b*. In other words, the securing element 1500 moves upward from a lowermost position to a first intermediate position to clear the height of the heads 1223 of the bolts 1222. As shown in FIGS. 27 and 29, this upward movement is permitted because the height of the head $H_H$ of the bolt 1222 is less than the height of the gap $H_G$, which extends between the top surface 1502*a* of the securing element 1500, in the lowermost position, and the upper surface 1132 of the side wall 1130 of the first and second rails 1110*a*, 1110*b*. It should be understood that in other embodiments, the heads 1223 of the bolts 1222 may be omitted or positioned outside of the channel 1122, such that said channel 1122 is not obscured and the securing element 1500 does not have to move from a lowermost position to a first intermediate position to clear the height $H_H$ of the heads 1223 of the bolts 1222.

As best shown in FIGS. 24-27, the retaining assembly 1300 is designed to secure the first and second rails 1110*a*, 1110*b* in the footing 1800. The retaining assembly 1300 includes at least one and preferably a plurality of anchors 1310. Said anchors 1310 depend downward from the bottom wall 1140 of the first and second rails 1110*a*, 1110*b*. The anchors 1310 are primarily comprised of three portions: (i) a first or threaded portion 1312*a*, (ii) a second or linear portion 1312*b*, and (iii) a third or non-linear (e.g., curvilinear or angled) portion 1312*c*. The first or threaded portion 1312*a* is designed to secure said anchor 1310 to the rail 1110*a*, 1110*b*. To accomplish this, the threaded portion 1312*a* extends through an opening 1314 formed in the bottom wall 1140 of the first and second rails 1110*a*, 1110*b*, into the channel 1122, and into a threaded coupling nut 1320. By positioning the portion 1312*a* of the anchors 1310 and the threaded coupling nut 1320 within the channel 1122, a portion of the channel 1122 is obscured and the securing element 1500 must move vertically up in the channel 1122 to overcome said the portion 1312*a* of the anchors 1310 and the threaded coupling nut 1320 in order to move from being positioned in the channel 1122 formed by rails 1110*a*, 1110*b* to being positioned in the channel 1122 formed by rails 1112*a*, 1112*b*. In other words, the securing element 1500 moves upward from a lowermost position to a second intermediate position to clear the height of the portion 1312*a* of the anchors 1310 and the threaded coupling nut 1320. As shown in FIGS. 27 and 29, this upward movement is permitted because the height of the coupling nut $H_{CN}$ is less than the height of the gap $H_G$, which extends between the top surface 1502*a* of the securing element 1500, in the lowermost position, and the upper edge surface 1132 of the side wall 1130 of the first and second rails 1110*a*, 1110*b*. It should be understood that in other embodiments, the portion 1312*a* of the anchors 1310 and the threaded coupling nut 1320 may be omitted or positioned outside of the channel 1122, such that said channel 1122 is not obscured and the securing element 1500 does not have to move from a lowermost position to a second intermediate position to clear the height $H_{CN}$ of the portion 1312*a* of the anchors 1310 and the threaded coupling nut 1320. In comparative order, the height of head height $H_H$ is less than the height of the coupling nut $H_{CN}$, both of which are less than the height of the gap $H_G$, all three are less than the height Hs.

The second or linear portion 1312*b* of the anchor 1310 extends downward from and is integrally formed with the threaded portion 1312*a* of the anchor 1310. The second portion 1312*b* is designed to help ensure that the length of the anchor 1310 is sufficient to retain the tract assembly 1100 in the footing 1800. The third or angled portion 1312*c* extends outward from and is integrally formed with the second portion 1312*b* of the anchor 1310. The third portion 1312*c* is angled relative to the second portion 1312*b* and is designed to ensure that the anchor 1310 is retained in the tract assembly 1100 in the footing 1800. As shown in the Figures, the third portion 1312*c* includes both linear and curvilinear extents. It should be understood that in other embodiments, the third or angled portion 1312*c* may be linear or be curvilinear.

Figure 28:
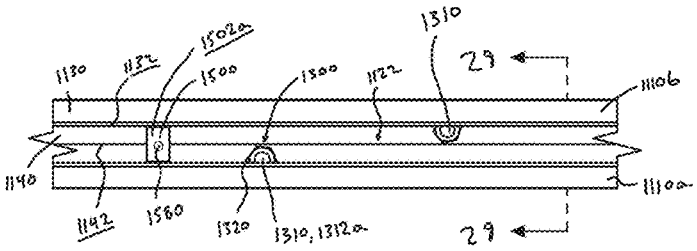
FIG. 28 is a top view of a portion of the track assembly of FIG. 24 with the securing element positioned in a channel of the track assembly.

As shown in FIGS. 26, 28, and 29, the positional relationship of the anchors 1310 alternate from the first rail 1110*a* to the second rail 1110*b* along their lengths. As such, the anchors 1310 are arranged along the length of the channel 1122 in an alternating rail to rail 1110*a*, 1110*b* fashion. This design is beneficial because it minimize the number of anchors 1310 that are utilized, and maximizes retainment of the track assembly 1100 in the footing 1800 without increasing the number of anchors 1310. This design is also desirable because the first and second rails 1110*a*, 1110*b* are not directly coupled to one another and therefore both rails 1110*a*, 1110*b* should include anchors 1310 to help ensure that said rail 1110*a*, 1110*b* is not dislodged from the footer 1800. In other embodiments, the rails 1110*a*, 1110*b* may be integrally formed, which could allow for the omission of this alternating design and instead the anchors 1310 may be aligned in the middle of the bottom wall 1140. In even further embodiments, the anchors 1310 may extend from the rails 1110*a*, 1110*b* in other directions (e.g., laterally) to further secure the rails 1110*a*, 1110*b* in the footing 1800.

ii. Securing Element

Figure 23:
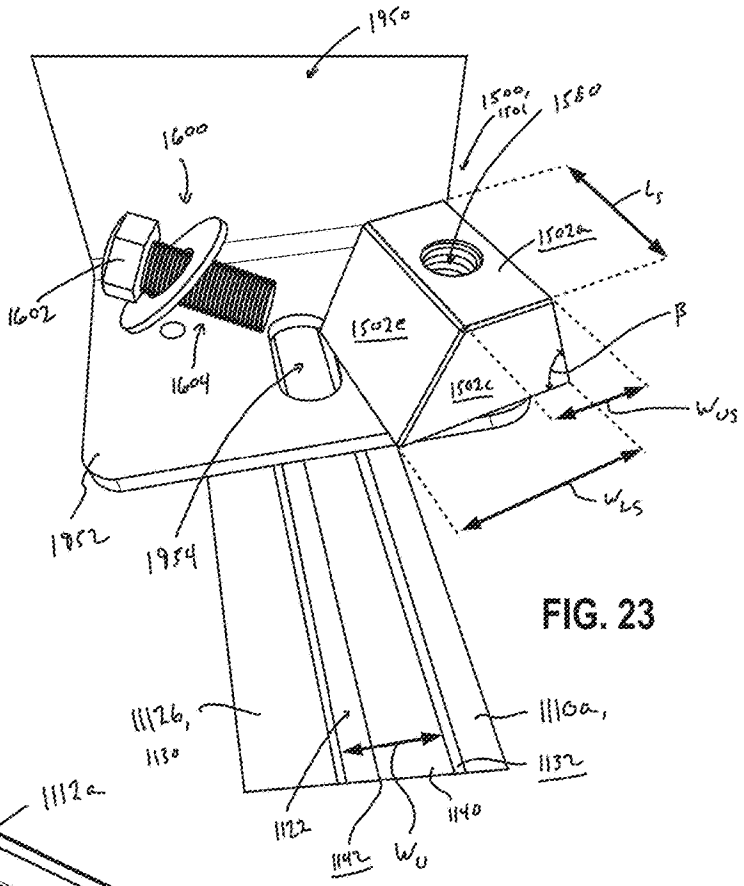
FIG. 23 is a perspective view of the adjustable anchor system of FIG. 22 showing a post bracket, a track assembly, a securing element, and a fastener.
Figure 24:
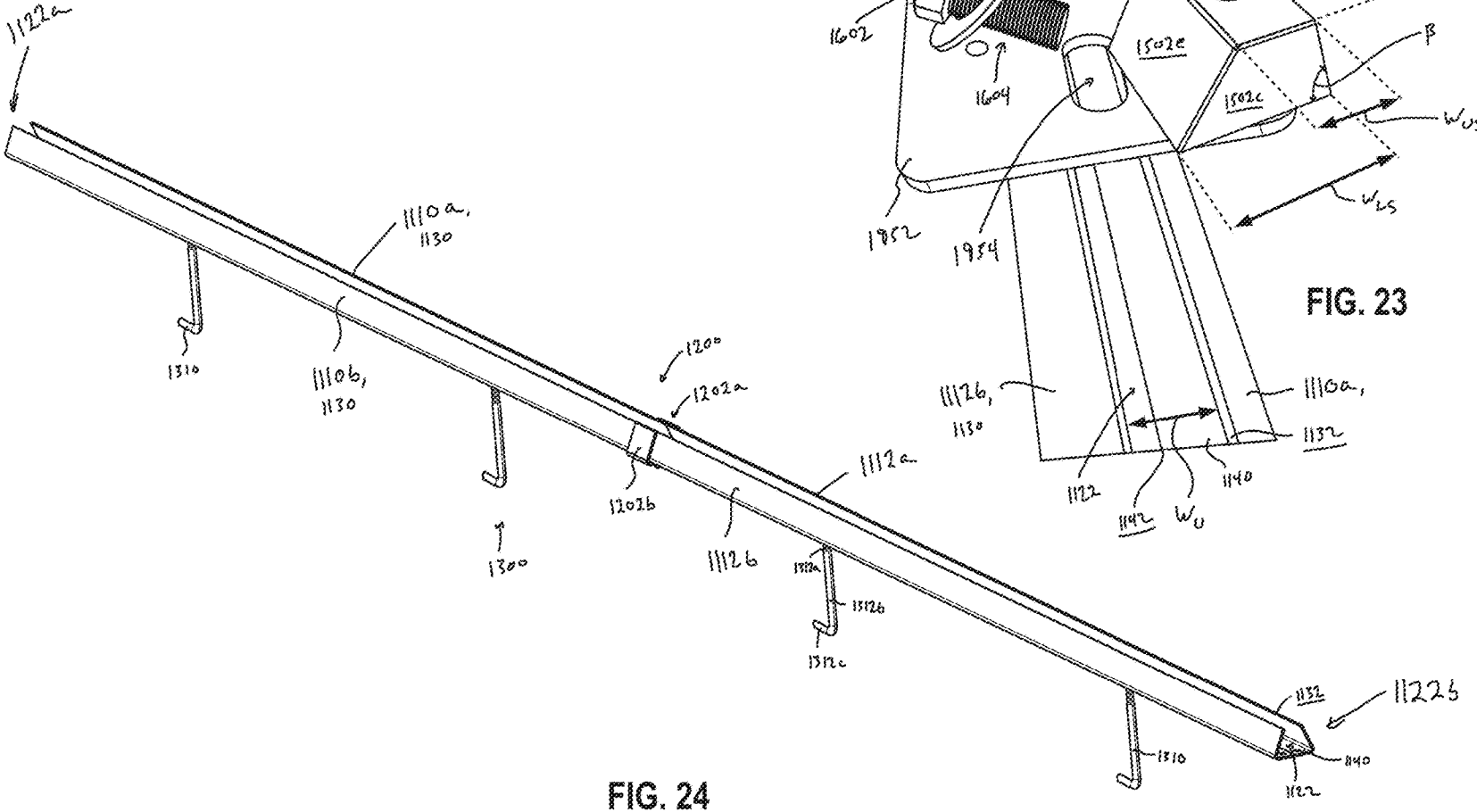
FIG. 24 is a perspective view of the track assembly of FIG. 23, the track assembly having an intermediate connecting assembly and a plurality of retaining anchors.
Figure 25:
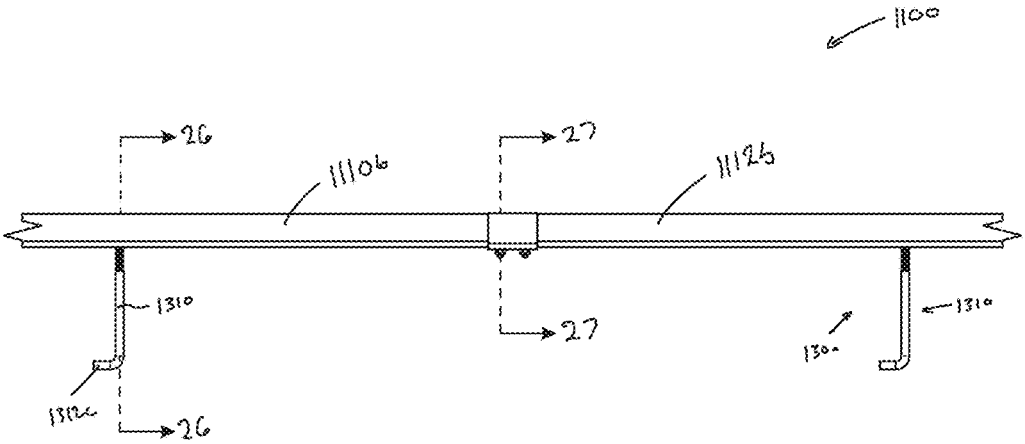
FIG. 25 is a side view of a portion of the track assembly of FIG. 24, the track assembly including opposed rails, a connecting assembly, and two retaining anchors.
Figure 35:
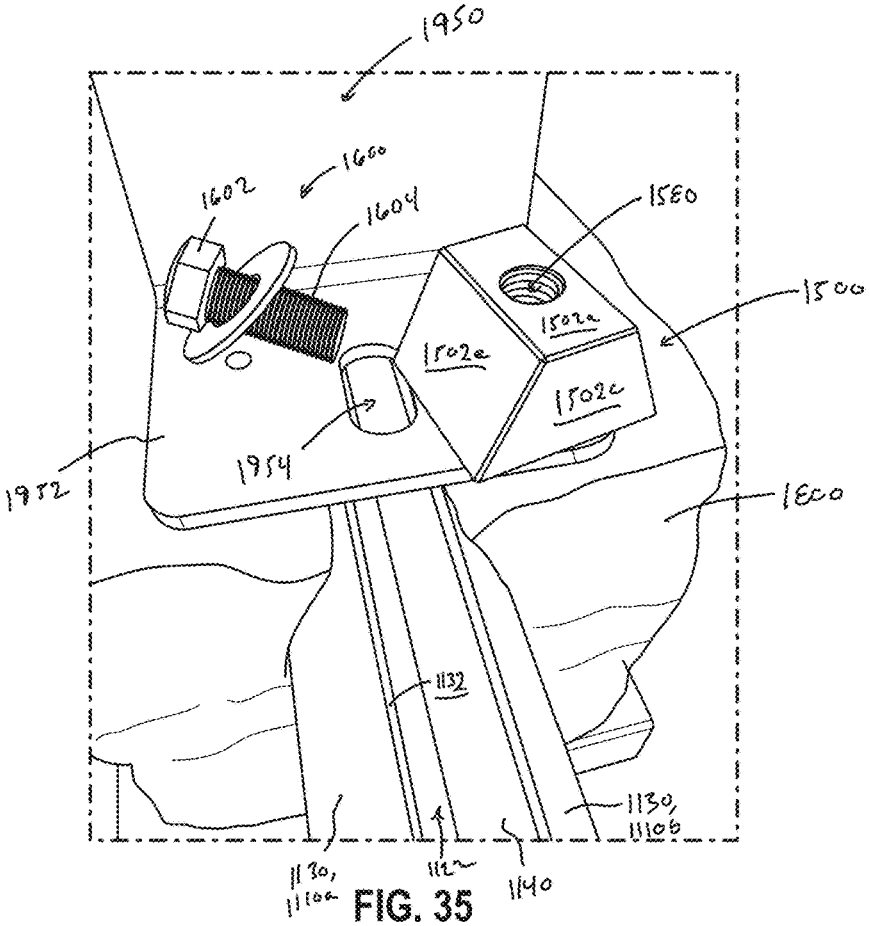
FIG. 35 is a perspective view of a portion of the building support footer assembly and the adjustable anchor system prior to depositing the securing element in the track assembly.
Figure 36:
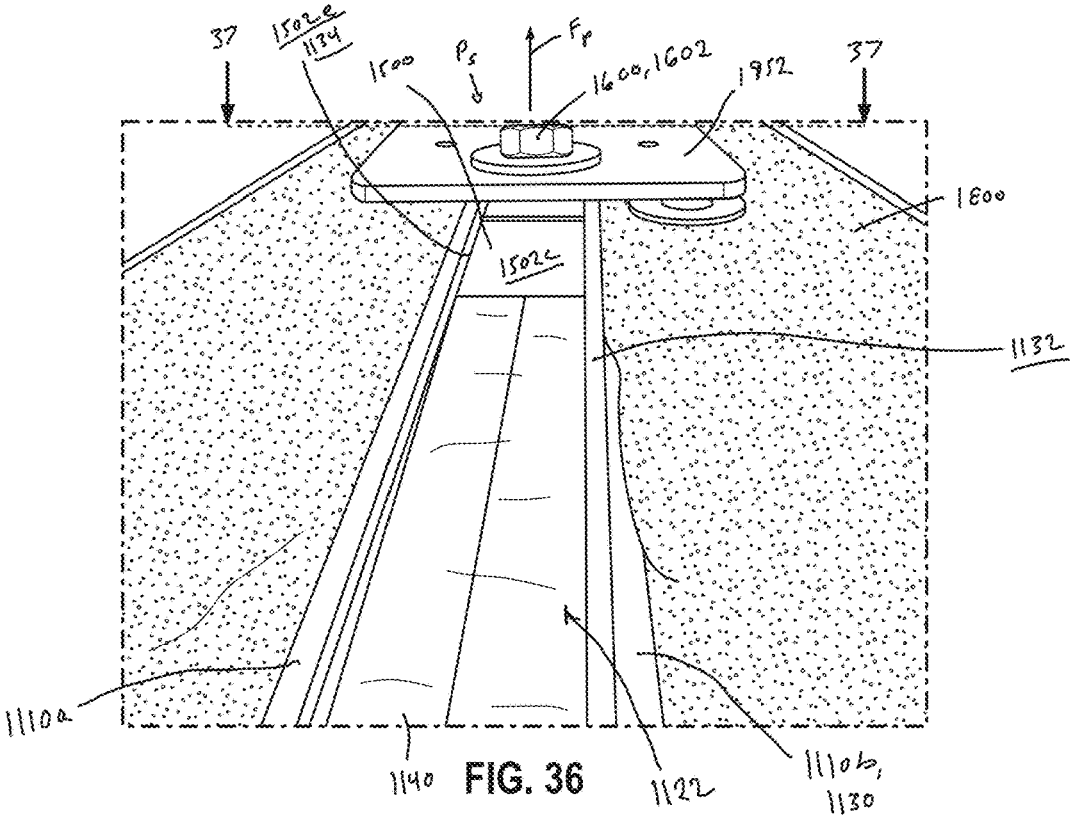
FIG. 36 is a perspective view of the adjustable anchor system residing with a portion of the building support footer assembly in a secured position.

As best shown in FIGS. 23, 35, and 36, the securing element 1500 has an exterior configuration that substantially matches the configuration of the channel 1122. This correspondence is desirable because it facilitates the sliding engagement of the securing element 1500 within the channel 1122, minimizes space required by the system 1000, and improves retention of the securing element 1500 within the channel 1122. In the embodiment shown in the figures, the securing element 1500 has an exterior configuration that forms a trapezoidal prism. Thus, the trapezoidal prism shape of the securing element 1500 substantially matches the trapezoidal cross-sectional shape of the channel 1122. The securing element 1500 has a wall arrangement 1501 that includes six walls that provide six surfaces, wherein the top and bottom walls have surfaces 1502*a*, 1502*b* that are positioned substantially parallel with one another, the front and back wall have surfaces 1502*c*, 1502*d* are also positioned substantially parallel with one another, and the first and second side walls have surfaces 1502*e*, 1502*f* are not parallel nor perpendicular with one another. Instead, the first and second side surfaces are angled relative to the top and bottom surfaces 1502*a*, 150*b*. As such, an interior angle beta β that extends between the side surfaces 1502*e*, 1502*f* and the bottom surface 1502*b* is between 20 and 130 degrees, preferably between 40 and 100 degrees, and most preferably 65 degrees. In other words, the interior angle beta β is a "significant acute angle," which means that the angle is greater than 60 degrees, but less than 80 degrees. In this embodiment, the interior angle beta β substantially matches the interior angle alpha α. In other words, the interior angle alpha α and the interior angle beta β are matching "significant acute angle," meaning that the angles are greater than 60 degrees, but less than 80 degrees.

As shown in FIG. 23, the securing element 1500 has an upper securing element width $W_{US}$ ($W_{US}$ is between 0.75 inch and 1.5 inches, preferably 1.2 inches), a lower securing element width $W_{LS}$ ($W_{LS}$ is between 1.75 inches and 2.25 inches, preferably 2 inches), and a securing element length $L_S$ ($L_S$ is between 3.5 inch and 6 inches, preferably 4 inches). The upper securing element width $W_{US}$ is slightly less than the upper channel width $W_U$, a lower securing element width $W_{LS}$ is slightly less than the lower channel width $W_L$, and a securing element length $L_S$ is considerably less than the length of the channel 1122. In addition, the lower securing element width $W_{LS}$ is considerably greater than the upper channel width $W_U$, which prevents the securing element 1500 from being inserted or removed through the mouth 1124 of the channel 1122 using an upwardly or downwardly directed force $F_U$, $F_D$. While the upper securing element widths $W_{US}$ is less than the upper channel width $W_U$, only a small portion of the securing element 1500 could extend into the channel 1122, if the user inverted the securing element 1500 and tried to insert the securing element 1500 into the channel 1122 in an inverted fashion, due to the sharp increasing of the width of the securing element 1500 when moving from the top surface 1502*a* to the bottom surface 1502*b*. Additionally, the securing element 1500 has a length $L_S$ that is considerably greater than the upper channel width $W_U$. This configuration prevents the securing element 1500 from being placed in the channel 1122 and then somehow rotated within said channel 1122. In other words, the securing element 1500 has a wall arrangement 1501 that defines a set of exterior dimensions (i.e., upper securing element width $W_{US}$, lower securing element width $W_{LS}$, securing element length $W_L$) of the securing element 1500, wherein the upper channel width $W_U$ is less than a majority of the exterior dimensions (i.e., lower securing element width $W_{LS}$, securing element length $W_L$) of the securing element 1500 thereby precluding insertion of the securing element 1500 into the channel 1122 at an intermediate portion of the channel 1122 and necessitating insertion of the securing element 1500 into the channel 1122 at a terminal ends 1122*a*, 1122*b* of the channel 1122.

The configuration of the securing element 1500 and the channel 1122 provide substantial benefits over conventional systems that lack these components because the configuration and dimensions of the securing element 1500 and the channel 1122 and their structural interaction: (i) preclude the securing element 1500 from being angularly displaced or rotated within the channel 1122 or dislodged from the channel 1122, namely the mouth 1124 of the channel 1122, (ii) ensures that a minor lateral force applied to the post bracket 82 does not dislodge the securing element 1500 from the channel 1122, and (iii) dramatically increases the physical contact and interaction between the surface area 1502*e*, 1502*f* (of the securing element 1500) to surface area 1134 (of the walls 1130 of the rails 1110) which prevents unwanted movement of the element 1500 in the channel 1122. Because the entire surface area 1502*e*, 1502*f* of the securing element 1500 makes direct contact with the surface area 1134 of the walls 1130 of the rails 1110 (see FIG. 38), a pullout force $F_P$ needed to dislodge the securing element 1500 from the channel 1122 would have to be massive and extremely unlikely to occur in the field. While the configuration of the securing element 1500 and the channel 1122 provides the anchoring system 1000 with the above described benefits, the configuration of the securing element 1500 and the channel 1122 is unconventional because it reduces the usability of the system 1000 since the installer must either: (a) "pre-load" the securing element 1500 which means the installer must insert all securing elements 1500 within the track assembly 1100 before it is installed in a footer 1800, or (b) "after install" which means that the building must be designed to allow the installer to physically access an end of the channel 1122 for insertion of the securing element 1500 after the channel 1122 is formed in the footing 1800. However, pre-loading the securing elements 1500 within the track assembly 1100 can be problematic if: (i) walls are added to the building structure after the track assembly 1100 is installed in the footing 1800, (ii) a securing element 1500 is somehow damaged during installation, which may prevent securement of a post 80 due to the lack of available securing elements 1500, or (iii) additional securing elements 1500 are pre-loaded in the channel 1122 as back-ups were not needed, which may increase the cost of the system 1000. Alternatively, adding the securing elements 1500 after install of the track assembly 1100 may be undesirable because: (i) the physical configuration of the building may not provide access to the ends of channel 1122*a*, 1122*b* after installation, or (ii) exposing the ends of the channel 1122*a*, 1122*b* may prove harmful to the building because natural elements (e.g., insects, bugs, varmints) may find their way into the channel 1122.

Figure 38:
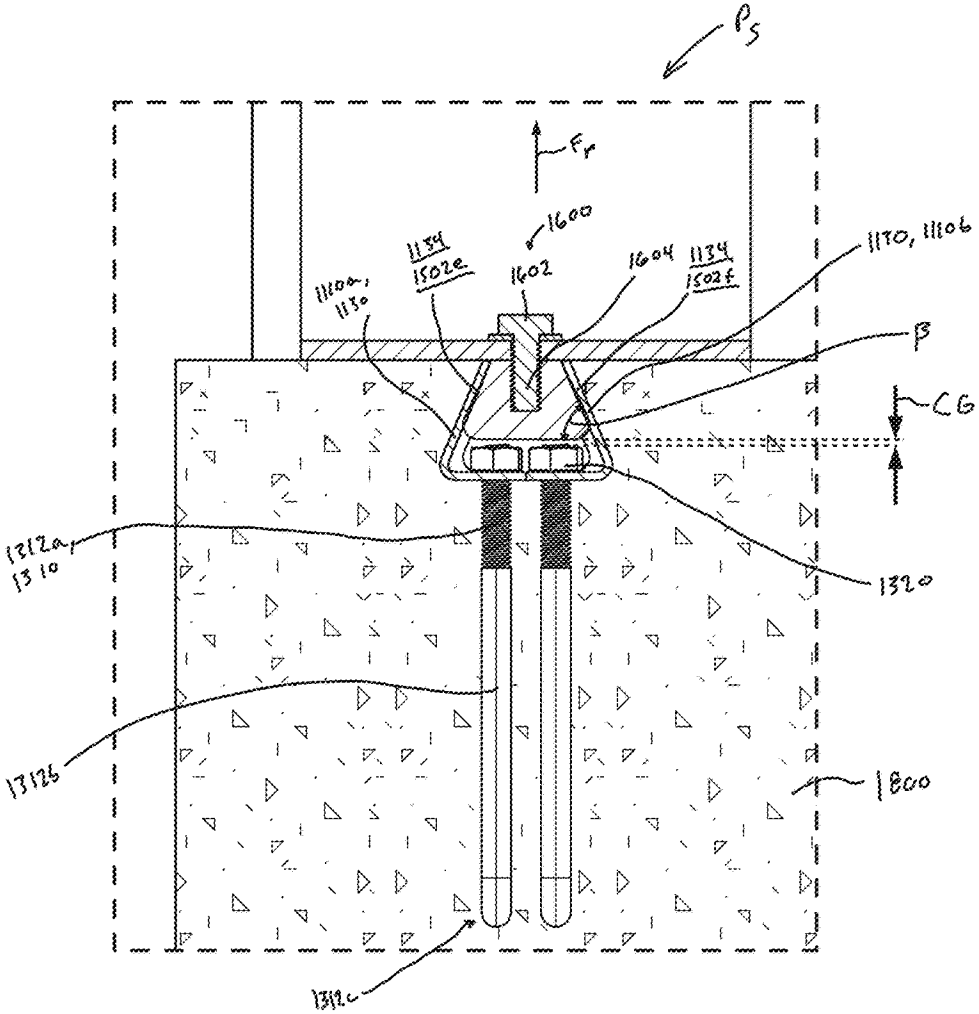
FIG. 38 is a zoomed-in view of the adjustable anchor system, the secured post and the portion of the building support footer assembly of FIG. 37.

As best shown in FIGS. 23, 35, and 38, the top wall 1502*a* of the securing element 1500 includes an opening 1580 configured to receive a threaded fastener 1600. The threaded fastener 1600 includes: (i) a head 1602, and (ii) a threaded body 1604. Said threaded body 1604 is designed to be cooperatively dimensioned to function with the threaded contained in the opening 1580 formed in the securing element 1500. It should be understood that in other embodiment, the threaded fastener 1600 may be replaced with any type of mechanical coupler quarter turn connector, a bayonet connector, a pressure fit, a pin and socket, ball detent connector, or any other similar connector type. In further alternative embodiments, a threaded fastener may extend upward from the securing element 1500 and a nut may be cooperatively dimensioned to function with upwardly extending threaded fastener.

B. Installation of Adjustable Anchor System

Figure 30:
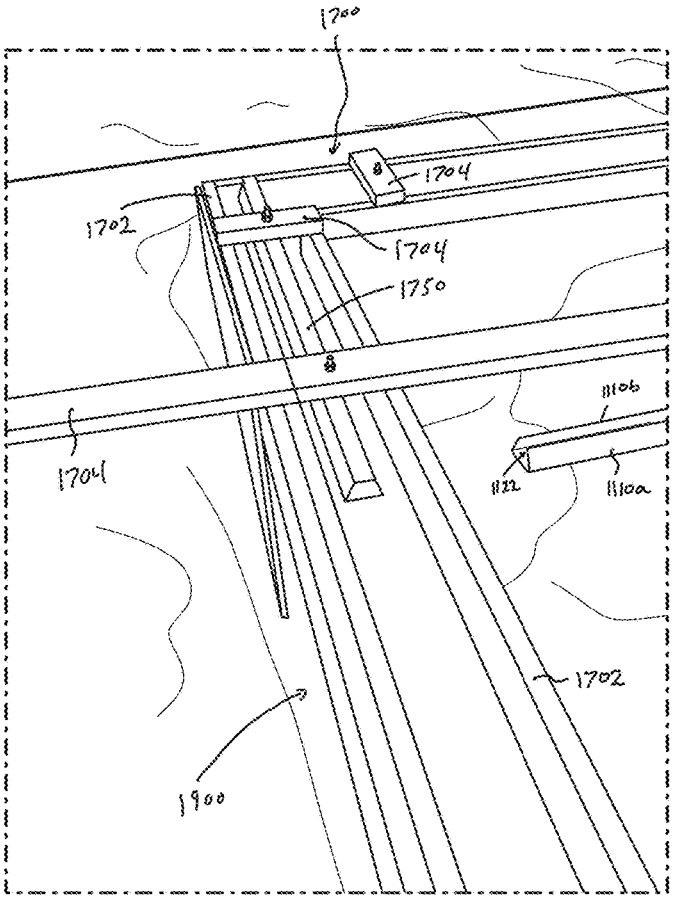
FIG. 30 is a perspective view of a form for positioning the track assembly in an extent of the building support footer assembly of FIG. 22.

FIGS. 30-38 show the installation of and functionality of the adjustable anchor system 1000. First, a hole 1900 for the footer 1800 is dug in the ground according to the building plans. Next, a form 1700 for the footer 1800 is placed in the hole 1900. As shown in FIG. 30, the form 1700 includes: (i) elongated members 1702 that define the sides of the footer 1800, and (ii) track supporting members 1704 that are designed to be coupled to the track assembly 1100. The track supporting members 1704 aid in the proper positioning of the track assembly 1100 in the footer 1800. To accomplish this: (i) securing elements 1500 are pre-loaded into the channel 1122 and the supporting members 1704 are coupled thereto via a threaded fastener, (ii) a channel 1122 obscurement device 1750 is utilized to cover and/or seal the channel 1122, and (iii) the supporting members 1704 are positioned on top and across the elongated members 1702. This configuration will allow the upper surface 1132 of the track assembly 1100 to be positioned substantially parallel with an uppermost surface of the footer 1800. Additionally, the obscurement device 1750 will prevent concrete from entering the channel 1122 during the formation of forming the footer 1800. The obscurement device 1750 may be: (i) a substantially rigid insert that can be inserted into the channel 1122, and wherein said substantially rigid insert has an upper extent with a width greater than the upper channel width $W_U$ and is configured to be positioned adjacent to the upper surface 1132 of the track assembly 1100, (ii) a plastic housing or strip that is designed to encase or substantially encase the rails 1110*a*, 1110*b*, which can be removed by tearing said plastic housing off the track assembly 1100, (iii) an elongated, slidingly removable channel insert that is configured to be positioned within the channel 1122 and slidingly removed after the formation of the footer 1800, (iv) any combination of the above described obscurement devices, or (v) any other similar structures that can functionally obscure the opening formed in the top of the channel 1122 to prevent concrete from entering said channel 1122.

Figure 31:
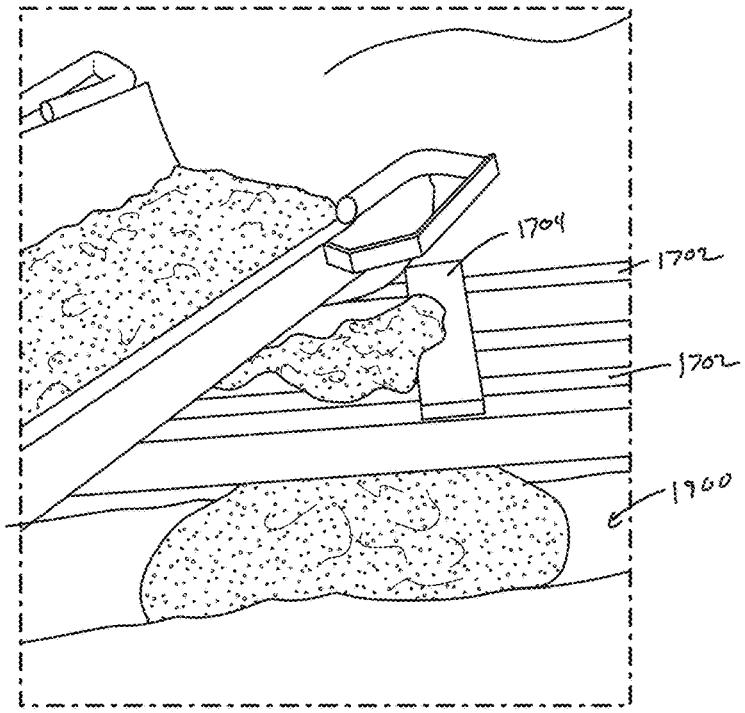
FIG. 31 is a perspective view of the form and the track assembly of FIG. 30, wherein concrete is being poured into said form to create the extent of the building support footer assembly.
Figure 32:
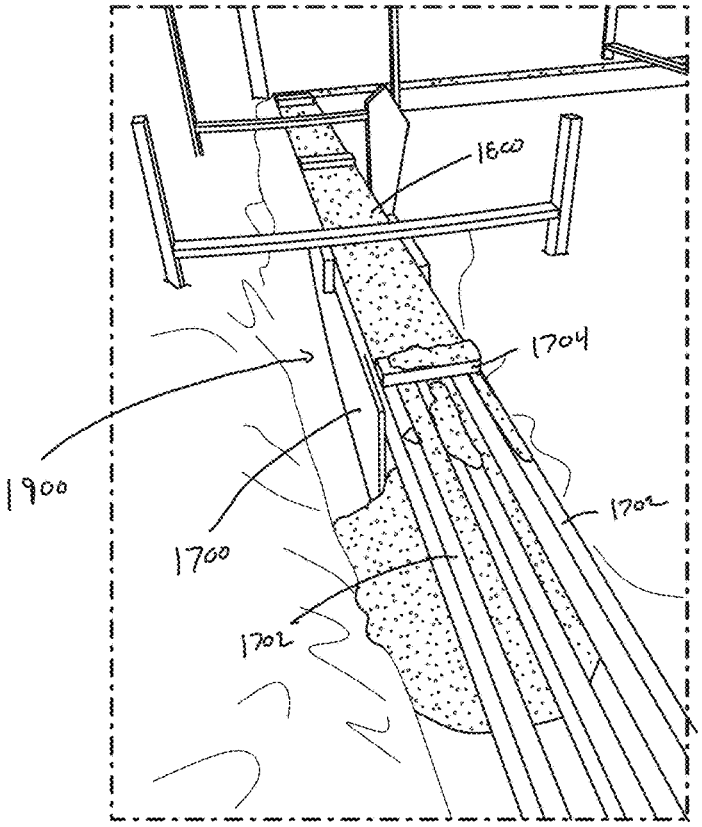
FIG. 32 is a perspective view of the form and track assembly of FIG. 31, wherein a first portion of the form is full of concrete and a second portion of the form lacks concrete.
Figure 33:
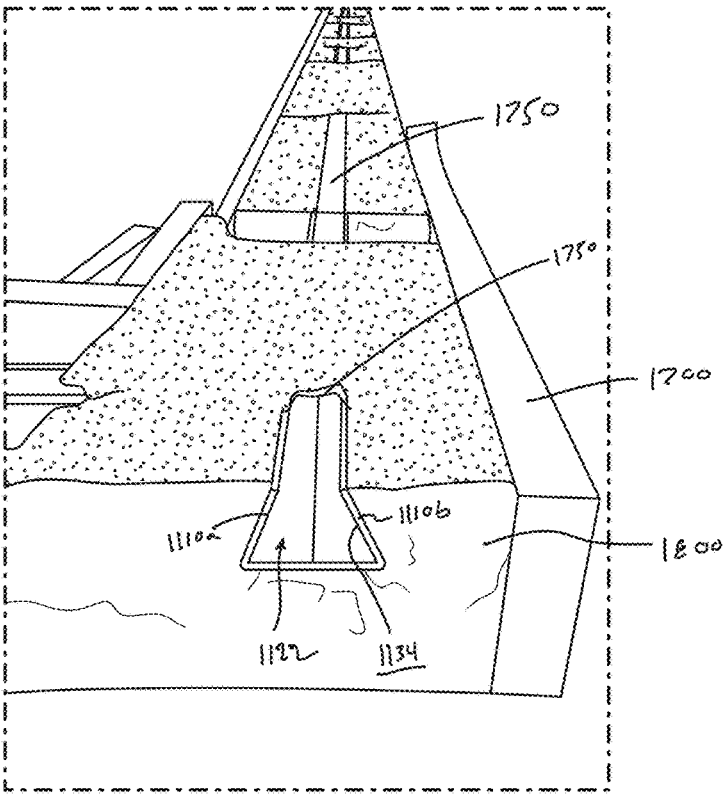
FIG. 33 is a perspective view of the track assembly positioned in the extent of the building support footer assembly.
Figure 34:
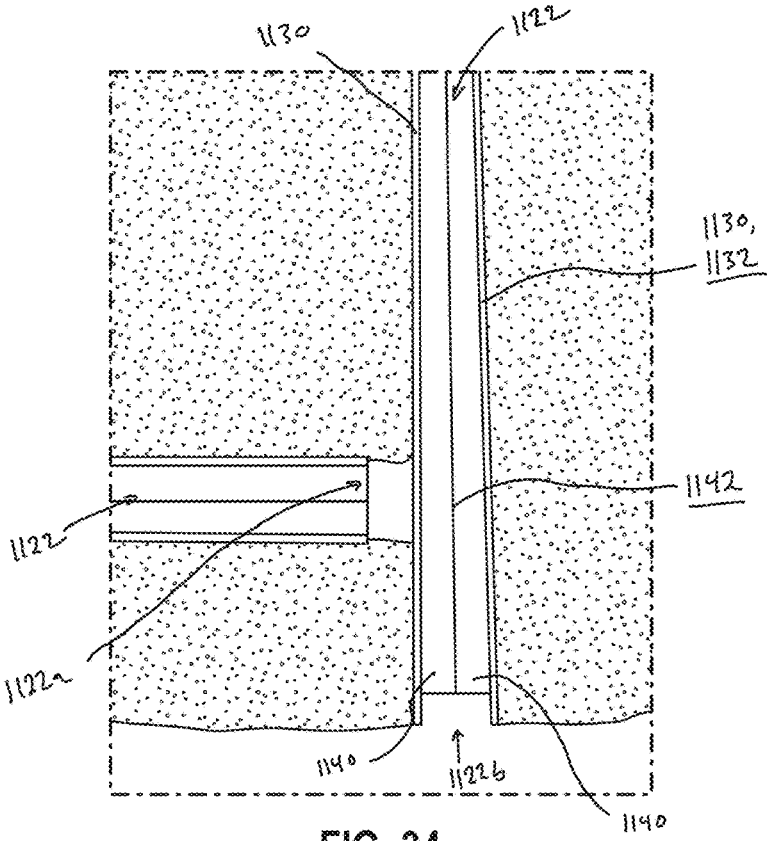
FIG. 34 is a top view of the track assembly positioned in the extent of the building support assembly.

After the above steps have been accomplished, the concrete or any other similar substance can be poured into the form 1700 to create the footer 1800 (see FIG. 31). After the concrete or any other similar substance is poured into the form 1700, the top extent of the form 1700 is scraped clean to form a substantially planar surface (see FIG. 32). Next, after the concrete or any other similar substance sufficiently cures, the installer can remove the obscurement device 1750 from the track assembly 1100 (see FIG. 33). As described above, the securing element 1500 cannot be inserted into the channel 1122 via the top opening in the channel 1122. Instead, the securing element 1500 must be inserted into the channel 1122 at a terminal end 1122*a*, 1122*b* of the channel 1122. FIG. 34 shows how the terminal end 1122*a* would be positioned in a footer 1800 to allow access to said end 1122*a*. Specifically, the terminal end 1122*a* abuts the end of the footer 1800, while a terminal end 1122*b* of another channel 1122 is positioned adjacent to the first wall 1130 of the track assembly 1100. In other words, for the square building structure that is shown in FIGS. 1-2, each wall will have a track assembly 1100. One end of the track assembly will abut an outer surface of the footer 1800 to provide terminal access to the channel 1122 after the track assembly 1100 have been installed in the footer 1800, while the opposed end does not need to be located in a position (e.g., adjacent to a side of another track assembly 1100) that will provide access to the terminal end of the track assembly 1100.

Next, the post brackets 1950 may be positioned in the desired location along the track assembly 1100 and the securing elements 1500 are inserted into the channel 1122 via the terminal end 1122*a* of the channel 1122. After inserting the securing elements 1500 into the channel 1122, the securing elements 1500 will be in a lowermost position, wherein the bottom surface 1502*b* of the securing element 1500 abuts the inner surface 1144 of the bottom wall 1140. As the securing element 1500 is slid along the length of the channel 1122, the securing element 1500 will likely move between the first and second intermediate positions in order to clear the coupling nut height $H_{CN}$ or the head height $H_H$. Once the securing element 1500 is properly positioned under a flange 1952 of the post bracket 1950, the fastener 1600 extends through an opening 1954 in the flange 1952 and interacts with the cooperatively dimensioned threads contained in the opening 1580 of the securing element 1500.

Figure 37:
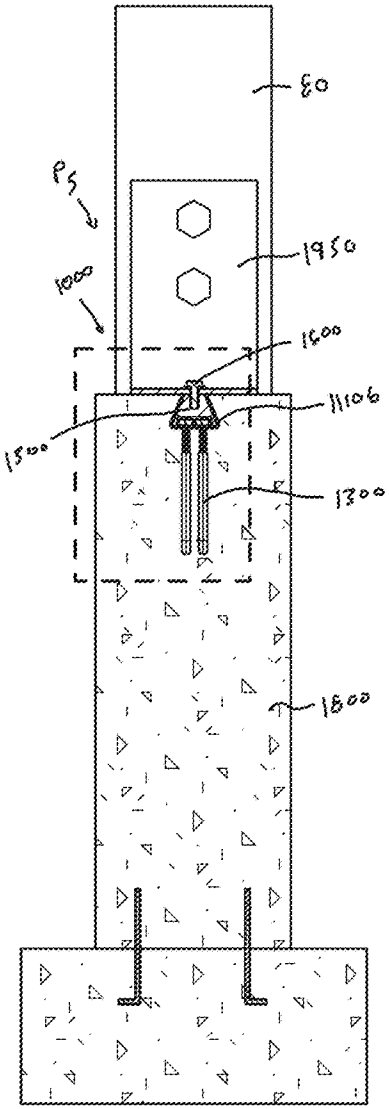
FIG. 37 is a cross-sectional view of the adjustable anchor system, a secured post and the portion of the building support footer assembly in the secured position and taken along line 37-37 of FIG. 36.
Figure 39:
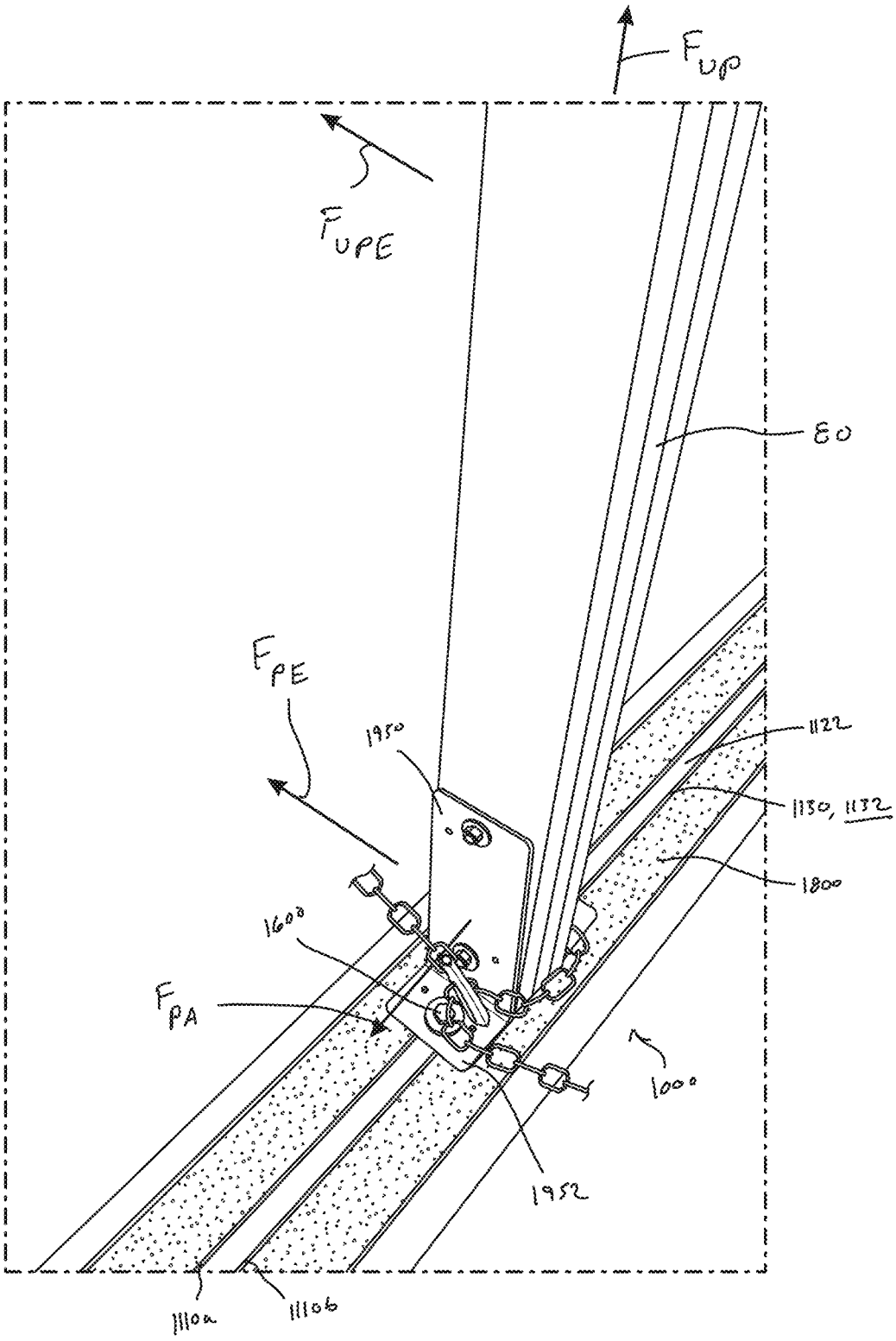
FIG. 39 is a perspective view of the adjustable anchor system, the secured post and the building support footer assembly in a secured position and showing forces applied thereto.

When the builder/installer applies a rotational force on the fastener 1600, the securing element 1500 is driven upward from its lowermost position—where the bottom surface 1502*b* of the securing element 1500 is positioned adjacent to the bottom wall 1140 of the rails 1110*a*, 1110*b*)—to the installed or uppermost position—where the side surfaces 1502*c*, 1502*f* of the securing element 1500 are positioned adjacent to and against an upper extent of the side wall 1130 of the rails 1110*a*, 1110*b*). As shown in FIG. 38, a clearance gap CG is formed between: (i) the upper most extent of the portion 1312*a* of the anchors 1310 and the threaded coupling nut 1320, and (ii) the bottom wall or surface 1502*b* of the securing element 1500. As described above, this clearance gap CG allows for the securing element 1500 to move freely within the channel 1122. In the final step, the installer can then couple the post 80 to the post bracket 1950 using an elongated coupler, which is best shown in FIGS. 36-38, to define a secured position $P_S$. In the secured position $P_S$, the post 80 and the post bracket 1950 are fixedly coupled to the footing 1800 at precise location selected by the installer. Testing of the inventive adjustable anchoring system 1000 reveals that the following forces are required to displace the post 80 and post bracket 1950 from the secured position $P_S$: (i) a parallel track force $F_{PA}$ of more than 3,000 pounds, (ii) a perpendicular track force $F_{PE}$ of more than 1,330 pounds, (iii) an upwardly directed force $F_{UP}$ of more than 1,010 pounds, or (iv) a upper perpendicular track force $F_{UPE}$, that is apply approximately 6 feet from the top surface of the footing, of more than 185 pounds. None of these forces are common or expected to be found at building locations featuring the adjustable anchoring system 1000 and as a result, the adjustable anchoring system 1000 is extremely robust and reliable.

6) Installing the Sections of the Building Structure

As shown in FIG. 40-41, the wall assemblies 500*a*-500*d* are being coupled to a plurality of posts 80, wherein the posts each have an outer surface 82, and wherein said outer surfaces 82 are substantially co-planar, at the second location or job site. To couple said wall assemblies 500*a*-500*d* to the posts, the installer utilizes a machine to lift the wall assemblies 500*a*-500*d* off of the truck and hang them in the proper location. Once in the proper location, installers couple the wall assemblies 500*a*-500*d* to the posts using a conventional fastener. Said conventional fasteners may be used in this coupling of the structures because the wall section 500*a*-500*d* has a thickness $T_W$ that extends between: (i) an inner surface 550*a* positioned adjacent to the outer surfaces 82 of the posts 80, and (ii) an opposed outer surface 550*b*, and wherein the thickness $T_W$ of the wall assembly is less than 2.5 inches and preferably is 1.75 inches (not 3.5 or 5.5 inches). Because the wall assemblies 500*a*-500*d* are affixed directly to the posts 80 and not to a foundation or ground, a gap G is formed between a lower edge 104*a* of the elongated horizontal bottom member 104 and the ground, whereby said wall assembly is suspended above the ground. As such, the building includes a suspended or floating wall system. After all walls are attached to the posts 80, the trusses can be installed thereon and the roof sections 610*a*, 610*b* can be coupled thereto. The building process continues from this point forward and can use any conventional method of finishing the building structure.

As discussed above, the wall assemblies 500*a*-500*d* are fastened directly to the posts 80 to form the walls of the structure 10. The wall assemblies 500*a*-500*d* may extend the full length of the structure, which is unlike: (i) conventional stud framing, and (ii) conventional prefabricated walls. As such, each wall section 500*a*-500*d* may have a length that is greater than 8 foot. In some embodiments, the wall assemblies 500*a*-500*d* may have a length that is greater than 15 feet, greater than 20 feet, and can be greater than 60 feet. Building a single wall 500*a*-500*d* that spans the entire structure 10 is beneficial because the entire wall 500*a*-500*d* can be set at one time; thereby, reducing labor costs over other conventional prefabricated walls. Additionally, using wall assemblies 500*a*-500*d* that span the entire length of the building 10 increases the durability of the building because the elongated top member 104 is coupled to one or more posts 80, which inserts one or more bearing points; thereby, increasing the load capacity of the wall 500*a*-500*d* by at least 1 percent, preferably more than 10 percent.

A further benefit is the ability to design a wall that spans the entire length of the structure 10. This is achieved through the use of the floating or suspended wall assemblies 500*a*-500*d* fastened at least two posts 80, and preferably a plurality of posts 80. As shown in the Figures, each wall section 500*a*-500*d* is fastened to at least four posts 80. This eliminates the need for multiple small wall sections, which are either: (i) individually fastened together or (ii) fastened to only two posts. Wall assemblies 500*a*-500*d* that are capable of spanning the length of the structure 10 are significantly different than both: (i) conventional stud framed walls, and (ii) conventional prefabricated walls. In particular, the disclosed system 1 is significantly different because: (i) wall assemblies 500*a*-500*d* experience significantly different forces when being manufactured, shipped, and installed in comparison to conventional prefabricated walls, (ii) wall assemblies 500*a*-500*d* significantly reduce the amount of labor required to install in comparison to conventional prefabricated walls, and (iii) in comparison to conventional prefabricated walls, the disclosed wall assemblies 500*a*-500*d* reduce the number of: (a) elongated horizontal bottom members 102, (b) elongated horizontal tops 104, (c) horizontal girts 106, and (d) vertical members 110, which reduces material waste and increases the flexibility of using materials with different lengths.

Second Embodiment

Figure 42:
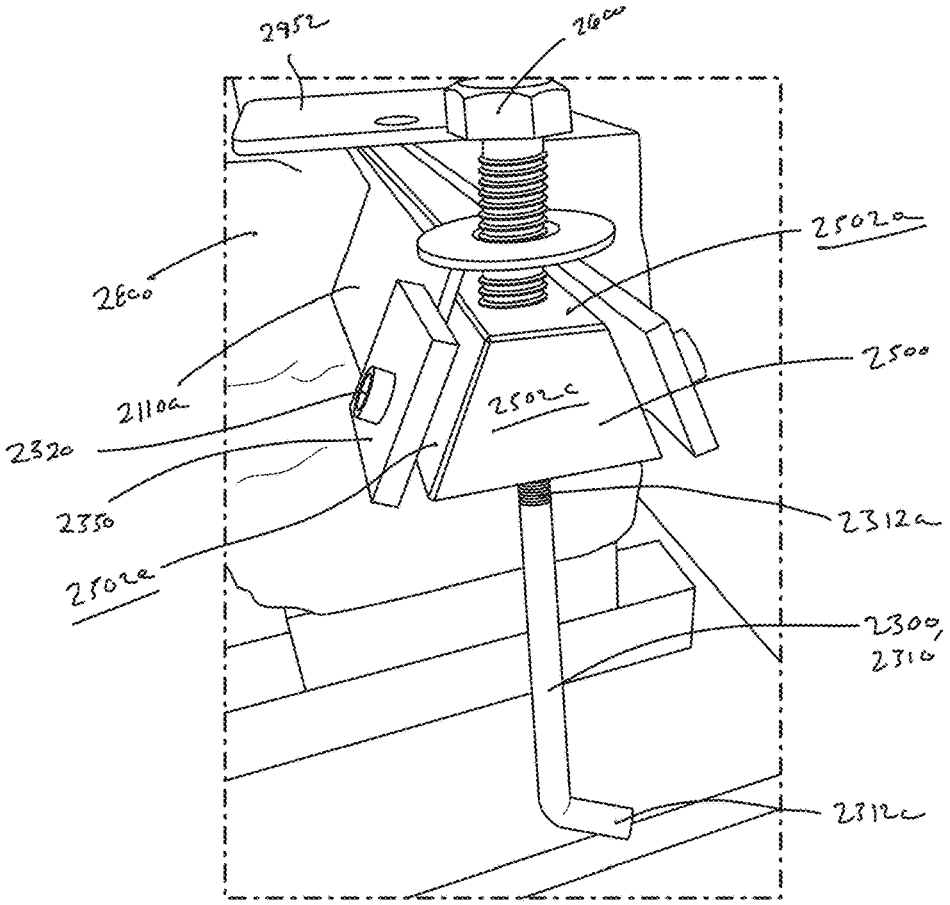
FIG. 42 is a perspective view of a second embodiment of the adjustable anchor system.

FIG. 42 show a second embodiment of the system 2000 that includes a track assembly 2100, a securing element 2500, and a fastener assembly 2600. Because a substantial majority of the structures contacted in this embodiment of the system 2000 are similar to the first embodiment of the system 1000, it should be understood that reference numbers that are shown in the figures may be omitted from the specification for sake of brevity as like structures have like numbers. For example, the disclosure in connection with securing element 1500 is not repeated herein, but it applies to securing element 2500, as if it were repeated herein. In other words, omitting reference numbers from the specification or specific disclosure of the functionality of that structure should not limit the disclosure of this application. Instead, one shall refer to the disclosure of similar structures that may be discussed within another section of this application or other applications incorporated herein by reference. Here, the threading coupling nuts 1320 from the first embodiment have been welded to plates 2350 that are coupled to the exterior surface of the rails 2110*a*, 2110*b*. This configuration helps prevent the channel 2122 from being partially obscured by the nuts 2320. Additionally, this embodiment discloses that additional anchors 2310 may be utilized the not positioned perpendicular with the bottom wall 2140 of the track assembly 2100.

Third Embodiment

Figure 43:
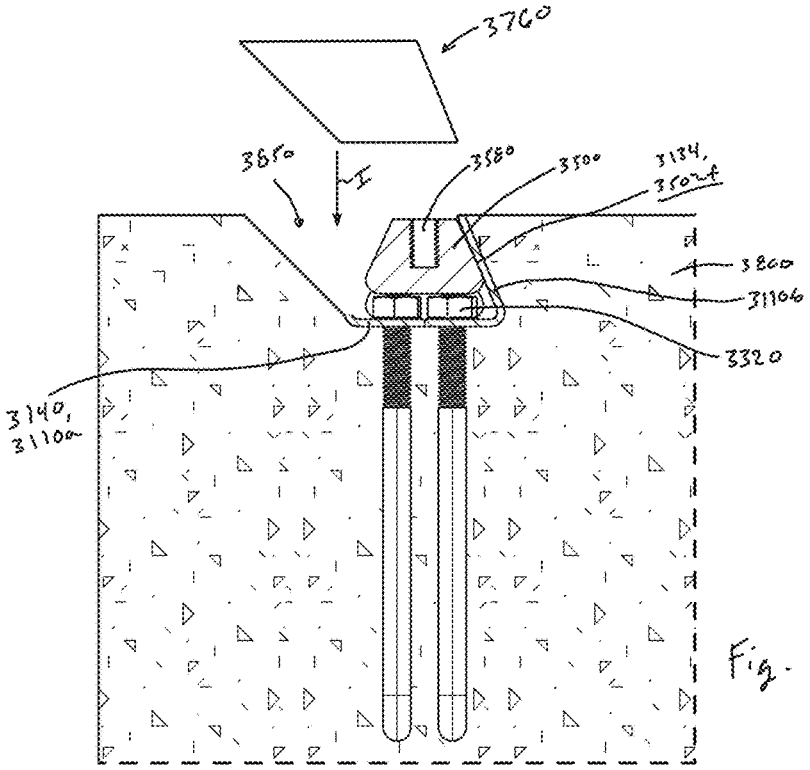
FIG. 43 is a cross-sectional view of a third embodiment of the adjustable anchor system.

FIG. 43 show a third embodiment of the system 3000 that includes a track assembly 3100, a securing element 3500, and a fastener assembly 3600. Because a substantial majority of the structures contacted in this embodiment of the system 3000 are similar to the first embodiment of the system 1000, it should be understood that reference numbers that are shown in the figures may be omitted from the specification for sake of brevity as like structures have like numbers. For example, the disclosure in connection with securing element 1500 is not repeated herein, but it applies to securing element 3500, as if it were repeated herein. In other words, omitting reference numbers from the specification or specific disclosure of the functionality of that structure should not limit the disclosure of this application. Instead, one shall refer to the disclosure of similar structures that may be discussed within another section of this application or other applications incorporated herein by reference. Here, an extent of the side wall 3140 has been removed and a wedge shaped obsecurement element 3760 has been inserted into the channel 3122 in the location where the side wall 3140 has been removed. Once the footer 1800 is set, the obsecurement element 3760 may be removed and the securing element 3500 can be inserted into the channel 3122. This design overcomes some of the reductions in usability, which are described above in connection with the first embodiment of the system 1000.

U.S. provisional patent application Nos. 63/254,091, 63/289,966 and 63/323,481 are hereby incorporated by references for all purposes. While some implementations have been illustrated and described, numerous modifications come to mind without significantly departing from the spirit of the disclosure; and the scope of protection is only limited by the scope of the accompanying claims. For example, the overall shape of the of the components described above may be changed to: a triangular prism, a pentagonal prism, a hexagonal prism, octagonal prism, sphere, a cone, a tetrahedron, a cuboid, a dodecahedron, an icosahedron, an octahedron, a ellipsoid, or any other similar shape.

Headings and subheadings, if any, are used for convenience only and are not limiting. The word exemplary is used to mean serving as an example or illustration. To the extent that the term includes, have, or the like is used, such term is intended to be inclusive in a manner similar to the term comprise as comprise is interpreted when employed as a transitional word in a claim. Relational terms such as first and second and the like may be used to distinguish one entity or action from another without necessarily requiring or implying any actual such relationship or order between such entities or actions.

Phrases such as an aspect, the aspect, another aspect, some aspects, one or more aspects, an implementation, the implementation, another implementation, some implementations, one or more implementations, an embodiment, the embodiment, another embodiment, some embodiments, one or more embodiments, a configuration, the configuration, another configuration, some configurations, one or more configurations, the subject technology, the disclosure, the present disclosure, other variations thereof and alike are for convenience and do not imply that a disclosure relating to such phrase(s) is essential to the subject technology or that such disclosure applies to all configurations of the subject technology. A disclosure relating to such phrase(s) may apply to all configurations, or one or more configurations. A disclosure relating to such phrase(s) may provide one or more examples. A phrase such as an aspect or some aspects may refer to one or more aspects and vice versa, and this applies similarly to other foregoing phrases.

Numerous modifications to the present disclosure will be apparent to those skilled in the art in view of the foregoing description. Preferred embodiments of this disclosure are described herein, including the best mode known to the inventors for carrying out the disclosure. It should be understood that the illustrated embodiments are exemplary only, and should not be taken as limiting the scope of the disclosure.

The invention claimed is:

1. A post frame building structure constructed with a rapid framing system, the post frame building structure including a plurality of posts secured in a ground surface, the post frame building structure comprising:

a wall assembly coupled to said plurality of posts and spanning an entire length of the post frame building structure, the wall assembly including:

an elongated horizontal top member with a first end, a second end, and an outer surface, an elongated horizontal bottom member with a first end, a second end, and an outer surface, a first end cap: (i) abutting both the first end of the elongated horizontal top member and the first end of the elongated horizontal bottom member, and (ii) having an outer surface that is substantially flush with the outer surface of the horizontal top and bottom members, a second end cap: (i) abutting both the second end of the elongated horizontal top member and the second end of the elongated horizontal bottom member, and (ii) having an outer surface that is substantially flush with the outer surface of the horizontal top and bottom members, a plurality of horizontal girts: (i) positioned between the elongated horizontal top member and the elongated horizontal bottom member, and (ii) having an outer surface that is substantially flush with the outer surface of the horizontal top and bottom members, and wherein the elongated horizontal top and bottom members, the first and second end caps, and the plurality of horizontal girts are coupled to one another using a plurality of coupling plates that are secured to the outer surface of each of said members, caps, and girts, wherein the wall assembly does not include a vertical member located between the first and second end caps that extends continuously and uninterrupted between the elongated horizontal top member and the elongated horizontal bottom member.

2. The post frame building structure of claim 1, wherein the wall assembly is not directly coupled to a foundation or a footer of the post frame building structure.

3. The post frame building structure of claim 1, wherein the wall assembly includes a vertical spacer assembly that includes a vertical spacer block positioned between each said horizontal girt of the plurality of horizontal girts.

4. The post frame building structure of claim 1, wherein each of the plurality of horizontal girts extend an entire length between the first and second end caps.

5. The post frame building structure of claim 1, wherein the wall assembly has an overall rigidity that is substantially provided by said plurality of girts being secured by said coupling plates.

6. The post frame building structure of claim 1, wherein a respective coupling plate of the plurality of coupling plates does not extend completely through an extent of the first or second end caps into the horizontal top member.

7. The post frame building structure of claim 1, wherein a respective coupling plate of the plurality of coupling plates include a plurality of projections, and wherein a length of the plurality of projections is less than a thickness of the wall assembly.

8. The post frame building structure of claim 1, wherein the elongated top and bottom members are not coupled to one another using elongated fasteners that extend therethrough.

9. The post frame building structure of claim 1, wherein the wall assembly is coupled to said plurality of posts using a plurality of elongated fasteners.

10. The post frame building structure of claim 9, wherein the elongated fasteners have a length that is less than about 2.5 inches.

11. A post frame building structure built using a rapid framing system, the post frame building structure comprising:

a plurality of posts secured in a ground surface;

a wall assembly coupled to said plurality of posts using a plurality of elongated fasteners, the wall assembly including:

an elongated horizontal top member with a first end and a second end, an elongated horizontal bottom member with a first end and a second end, a first end cap abutting both the first end of the elongated horizontal top member and the first end of the elongated horizontal bottom member, a second end cap abutting both the second end of the elongated horizontal top member and the second end of the elongated horizontal bottom member, a plurality of horizontal girts positioned between the elongated horizontal top member and the elongated horizontal bottom member, and at least one coupling plate that is secured to both an outer surface of the elongated horizontal top member and an outer surface of the first end cap; and wherein the wall assembly does not include a vertical member located between the first and second end caps that extends continuously and uninterrupted between the elongated horizontal top member and the elongated horizontal bottom member.

12. The post frame building structure of claim 11, wherein the wall assembly has a thickness that extends between: (i) an inner surface, and (ii) an opposed outer surface, and wherein the thickness of the wall assembly is less than 2.5 inches.

13. The post frame building structure of claim 11, wherein the wall assembly is not directly coupled to a foundation or a footer of the post frame building structure.

14. The post frame building structure of claim 11, wherein a gap is formed between a lower edge of the elongated horizontal bottom member and the ground surface, whereby said wall assembly is suspended above the ground surface.

15. The post frame building structure of claim 11, wherein the wall assembly includes a vertical spacer assembly that includes a plurality of vertical spacer blocks positioned between each said horizontal girt of the plurality of horizontal girts.

16. The post frame building structure of claim 11, wherein each of the plurality of horizontal girts extend an entire length between the first and second end caps.

17. A post frame building structure built using a rapid framing system, the post frame building structure comprising:

a plurality of posts secured in a ground surface;

a wall assembly coupled to said plurality of posts using a plurality of elongated fasteners, the wall assembly including:

an elongated horizontal top member with a first end and a second end, an elongated horizontal bottom member with a first end and a second end, a first end cap abutting both the first end of the elongated horizontal top member and the first end of the elongated horizontal bottom member, a second end cap abutting both the second end of the elongated horizontal top member and the second end of the elongated horizontal bottom member, a plurality of horizontal girts positioned between the elongated horizontal top member and the elongated horizontal bottom member and extend an entire length between the first and second end caps, and wherein at least one of the elongated horizontal top and bottom members, the first and second end cap, and the plurality of horizontal girts are coupled to one another using a coupling plate that is affixed to an outer surface of each of said members, caps, and girts, wherein the wall assembly does not include a vertical member located between the first and second end caps that extends continuously and uninterrupted between the elongated horizontal top member and the elongated horizontal bottom member.

18. The post frame building structure of claim 17, wherein the wall assembly has a thickness that extends between: (i) an inner surface, and (ii) an opposed outer surface, and wherein the thickness of the wall assembly is less than 2.5 inches.

19. The post frame building structure of claim 17, wherein the wall assembly is not directly coupled to a foundation or a footer of the post frame building structure.

20. The post frame building structure of claim 17, wherein a gap is formed between a lower edge of the elongated horizontal bottom member and the ground surface, whereby said wall assembly is suspended above the ground surface.

21. The post frame building structure of claim 17, wherein the wall assembly includes a vertical spacer assembly with a vertical spacer block positioned between two horizontal girts of the plurality of horizontal girts.

22. The post frame building structure of claim 17, wherein one of the elongated horizontal top or bottom members is coupled to one of the first or second end caps using a respective coupling plate, and wherein said respective coupling plate does not extend completely through an extent of the first or second end caps into the horizontal top member.

23. The post frame building structure of claim 17, wherein a respective coupling plate includes a plurality of projections, and wherein a length of the plurality of projections is less than a thickness of the wall assembly.

* * * * *